US006898392B2

(12) United States Patent
Karakama et al.

(10) Patent No.: US 6,898,392 B2
(45) Date of Patent: May 24, 2005

(54) PROCESS CARTRIDGE AND ELECTROPHOTOGRAPHIC IMAGE FORMING APPARATUS

(75) Inventors: Toshiyuki Karakama, Shizuoka (JP); Kazushi Watanabe, Shizuoka (JP); Kazuhide Kudo, Shizuoka (JP); Ryuta Murakami, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 80 days.

(21) Appl. No.: 10/207,081

(22) Filed: Jul. 30, 2002

(65) Prior Publication Data

US 2003/0215257 A1 Nov. 20, 2003

(30) Foreign Application Priority Data

May 17, 2002 (JP) ..... 2002-142267
Jul. 12, 2002 (JP) ..... 2002-204342

(51) Int. Cl.[7] ..... G03G 15/00; G03G 21/16

(52) U.S. Cl. ..... 399/90; 399/13; 399/25; 399/111

(58) Field of Search ..... 399/12, 13, 25, 399/37, 88, 90, 107, 111

(56) References Cited

U.S. PATENT DOCUMENTS

| | | | | |
|---|---|---|---|---|
| 5,095,335 | A | 3/1992 | Watanabe et al. | |
| 5,345,294 | A | 9/1994 | Nomura et al. | |
| 5,465,136 | A | 11/1995 | Watanabe et al. | |
| 5,500,714 | A | 3/1996 | Yashiro et al. | |
| 5,543,898 | A | 8/1996 | Shishido et al. | |
| 5,689,774 | A | 11/1997 | Shishido et al. | 399/111 |
| 5,749,027 | A | 5/1998 | Ikemoto et al. | 399/113 |
| 5,768,660 | A | 6/1998 | Kurihara et al. | 399/111 |
| 5,909,603 | A * | 6/1999 | Suzuki et al. | 399/13 |
| 5,937,239 | A | 8/1999 | Watanabe et al. | 399/111 |
| 5,963,759 | A * | 10/1999 | Kojima et al. | 399/111 |
| 6,006,058 | A | 12/1999 | Watanabe et al. | 399/167 |
| 6,097,908 | A | 8/2000 | Uchiyama et al. | 399/111 |
| 6,137,966 | A * | 10/2000 | Uehara et al. | 399/13 |
| 6,144,398 | A | 11/2000 | Yokoyama et al. | 347/263 |
| 6,169,866 | B1 | 1/2001 | Watanabe et al. | 399/111 |
| 6,175,706 | B1 | 1/2001 | Watanabe et al. | 399/167 |
| 6,253,036 | B1 | 6/2001 | Karakama et al. | 399/27 |
| 6,272,299 | B1 | 8/2001 | Numagami et al. | 399/111 |
| 6,349,182 | B2 * | 2/2002 | Otsubo et al. | 399/12 |
| 6,377,759 | B1 | 4/2002 | Abe et al. | 399/27 |
| 6,397,017 | B1 | 5/2002 | Sakai et al. | 399/27 |
| 6,397,018 | B1 | 5/2002 | Matsumoto et al. | 399/27 |

(Continued)

FOREIGN PATENT DOCUMENTS

| | | |
|---|---|---|
| JP | 2002-72782 | 3/2002 |
| JP | 2002-72783 | 3/2002 |
| JP | 2002-72784 | 3/2002 |
| JP | 2002-72823 | 3/2002 |
| JP | 2002-72824 | 3/2002 |
| JP | 2002-72825 | 3/2002 |

OTHER PUBLICATIONS

Abstract of Japanese Patent Laid Open No. 09–179476.

*Primary Examiner*—Sandra Brase
(74) *Attorney, Agent, or Firm*—Fitzpatrick, Cella, Harper & Scinto

(57) ABSTRACT

This process cartridge includes a frame body, a cartridge electrical contact, and a pushed portion provided on the frame body. The process cartridge is detachably attached to a main body of an electrophotographic image forming apparatus including a main body electrical contact, and a main body pusher. When the process cartridge is attached to the main body of the electrophotographic image forming apparatus, it is possible to achieve an electrically strong connection of the cartridge electrical contact to the main body electrical contact by the pushed portion being pushed by the main body pusher. Owing to this simple structure, it is possible to realize the electrical connection of the cartridge electrical contact to the main body electrical contact.

15 Claims, 31 Drawing Sheets

U.S. PATENT DOCUMENTS

| | | | | |
|---|---|---|---|---|
| 6,400,914 | B1 | 6/2002 | Noda et al. | 300/90 |
| 6,404,995 | B1 * | 6/2002 | Kimizuka | 399/13 |
| 2002/0025185 | A1 | 2/2002 | Ito et al. | 399/111 |
| 2002/0025186 | A1 | 2/2002 | Karakama et al. | 399/111 |
| 2002/0031357 | A1 | 3/2002 | Watanabe et al. | 399/12 |
| 2002/0031359 | A1 | 3/2002 | Karakama et al. | 399/25 |

* cited by examiner

PROCESS CARTRIDGE AND ELECTROPHOTOGRAPHIC IMAGE FORMING APPARATUS

BACKGROUND OF THE INVENTION

1. Filed of the Invention

The present invention relates to a process cartridge, which can be detached from or attached to a main body of an electrophotographic image forming apparatus, and an electrophotographic image forming apparatus.

2. Description of Related Art

Here, the electrophotographic image forming apparatus is an apparatus for forming an image on a recording medium by using an electrophotographic image forming process. Then, as examples of the electrophotographic image forming apparatus, for example, an electrophotographic copying machine, electrophotographic printers (for example, a laser beam printer, an LED printer, etc.), a facsimile machine, a word processor, and the like are included.

In addition, the process cartridge is a cartridge that is made by integrating charging means, developing means, or cleaning means, which are process means, and an electrophotographic photosensitive body, and enables this cartridge to be detached from or attached to a main body of the electrophotographic image forming apparatus. Furthermore, the process cartridge is a cartridge that is made by integrating at least one of charging means, developing means, and cleaning means, which are process means, and an electrophotographic photosensitive body, and enables the cartridge to be detached from or attached to a main body of the electrophotographic image forming apparatus, and a cartridge that is made by integrating at least developing means, which is process means, and an electrophotographic photosensitive body, and enables the cartridge to be detached from or attached to a main body of the electrophotographic image forming apparatus.

Conventionally, what is adopted in an electrophotographic image forming apparatus using an electrophotographic image forming process is a process cartridge system where an electrophotographic photosensitive body and process means acting on the electrophotographic photosensitive body are made to be a cartridge by being integrated, and this cartridge is enabled to be attached to or detached from a main body of the electrophotographic image forming apparatus. Since it is possible to maintain the apparatus by a user without maintenance personnel according to this process cartridge system, it is possible to increase operability sharply. Then, this process cartridge system is widely used in electrophotographic image forming apparatuses.

In addition, in recent years, products where a memory (memory element) storing various service information and process information is installed in each cartridge are realized. In the electrophotographic image forming apparatuses, by utilizing the memory information in this cartridge, image quality and maintenability of the cartridge are further enhanced. Then, there are some elements, each of which is performing electric communication with a memory of a cartridge by being electrically connected to a connector provided in a main body of the electrophotographic image forming apparatus.

However, if a conventional contact type connector is used, in order to realize a secured electrical connection, there is a possibility that the communication structure of a main body of an electrophotographic image forming apparatus and a contact portion of memory in a cartridge may become complicated.

The present invention is made in view of the unsolved problems of conventional technology.

SUMMARY OF THE INVENTION

An object of the present invention is to provide a process cartridge and an electrophotographic image forming apparatus, where an electrical contact portion of the process cartridge can be electrically connected to a main body electrical contact of the electrophotographic image forming apparatus in a simple structure.

Another object of the present invention is to provide a process cartridge and an electrophotographic image forming apparatus, where a main body electrical contact, provided in a main body of the electrophotographic image forming apparatus, can be electrically connected to a cartridge electrical contact portion surely and stably when the process cartridge is attached to the above-described main body of the electrophotographic image forming apparatus.

Still another object of the present invention is to provide a process cartridge and an electrophotographic image forming apparatus, where a main body electrical contact, provided in a main body of the electrophotographic image forming apparatus, can abut on a cartridge electrical contact without contacting a frame body of the process cartridge, and a main board except the cartridge electrical contact when the process cartridge is attached to the above-described main body of the electrophotographic image forming apparatus.

In addition, a further object of the present invention is to provide a process cartridge and an electrophotographic image forming apparatus that are actually miniaturized and save space.

Furthermore, a still further object of the present invention is to provide a process cartridge and an electrophotographic image forming apparatus, where a main body electrical contact, provided in a main body of the electrophotographic image forming apparatus, can be electrically connected to a cartridge electrical contact portion surely and stably in the condition that the process cartridge is attached in an attachment position of the above-described main body of the electrophotographic image forming apparatus.

Moreover, another object of the present invention is to provide a process cartridge and an electrophotographic image forming apparatus, where the accuracy of a position, where a main body electrical contact, provided in a main body of the electrophotographic image forming apparatus, abut on a cartridge electrical contact portion when the process cartridge is attached to the above-described main body of the electrophotographic image forming apparatus, is good.

In addition, still another object of the present invention is to provide a process cartridge and an electrophotographic image forming apparatus, where a main body electrical contact, provided in a main body of the electrophotographic image forming apparatus, can smoothly contact a cartridge electrical contact portion without a shock when the process cartridge is attached to the main body of the electrophotographic image forming apparatus.

Furthermore, a further object of the present invention is to provide a process cartridge that is detachable from a main body of an electrophotographic image forming apparatus that has a main body electrical contact and main body pushing means, comprising:

an electrophotographic photosensitive drum;

process means of acting on the electrophotographic photosensitive drum;

a frame body;

a memory element storing information;

a cartridge electrical contact portion that is electrically connected to the memory element, and is electrically connected to the main body electrical contact when the process cartridge is attached to the main body of the electrophotographic image forming apparatus;

a main board that is provided in the frame body, and has the memory element and the cartridge electrical contact portion; and a pushed portion that is provided in the frame body, and in which the main body electrical contact and the cartridge electrical contact portion are pushed in the direction of being electrically connected by the main body pushing means when the process cartridge is attached to the main body of the electrophotographic image forming apparatus.

Moreover, a still further object of the present invention is to provide a process cartridge that is detachable from a main body of an electrophotographic image forming apparatus that has a main body electrical contact and a main body abutting-member, comprising:

an electrophotographic photosensitive drum;

process means of acting on the electrophotographic photosensitive drum;

a frame body;

a memory element storing information;

a cartridge electrical contact portion that is electrically connected to the memory element, and is electrically connected to the main body electrical contact when the process cartridge is attached to the main body of the electrophotographic image forming apparatus;

a main board that is provided in the frame body, and has the memory element and the cartridge electrical contact portion;

a cartridge abutting portion that is provided in the same side as the main board with projecting from the frame body, and guides the main body electrical contact to the cartridge electric contact portion with contacting the main body abutting member when the process cartridge is attached to the main body of the electrophotographic image forming apparatus; and an inclined plane that is provided in an upstream side of the cartridge abutting portion in an attachment direction in which the process cartridge is attached to the main body of the electrophotographic image forming apparatus, and serves to electrically connect the main body electrical contact, guided by the main body abutting member, to the cartridge electrical contact portion when the process cartridge is attached to the main body of the electrophotographic image forming apparatus.

In addition, another object of the present invention is to provide an electrophotographic image forming apparatus that has a detachable process cartridge and forms an image on a recording medium, comprising:

(i) a main body electrical contact;

(ii) main body pushing means;

(iii) attachment means for detachably attaching a process cartridge comprising: an electrophotographic photosensitive drum; process means of acting on the electrophotographic photosensitive drum; a frame body; a memory element storing information; a cartridge electrical contact portion that is electrically connected to the memory element, and is electrically connected to the main body electrical contact when the process cartridge is attached to the main body of the electrophotographic image forming apparatus; a main board that is provided in the frame body, and has the memory element and the cartridge electrical contact portion; and a pushed portion that is provided in the frame body, and in which the main body electrical contact and the cartridge electrical contact portion are pushed in the direction of being electrically connected by the main body pushing means when the process cartridge is attached to the main body of the electrophotographic image forming apparatus; and (iv) conveying means for conveying the recording medium.

Furthermore, still another object of the present invention is to provide an electrophotographic image forming apparatus that has a detachable process cartridge and forms an image on a recording medium, comprising:

(i) a main body electrical contact;

(ii) a main body electrical contact supporting member that supports the main body electrical contact;

(iii) a main body abutting portion provided in the main body electrical contact supporting member;

(iv) attachment means for detachably attaching a process cartridge comprising: an electrophotographic photosensitive drum; process means of acting on the electrophotographic photosensitive drum; a frame body; a memory element storing information; a cartridge electrical contact portion that is electrically connected to the memory element, and is electrically connected to the main body electrical contact when the process cartridge is attached to the main body of the electrophotographic image forming apparatus; a main board that is provided in the frame body, and has the memory element and the cartridge electrical contact portion; a cartridge abutting portion that is provided in the same side as the main board with projecting from the frame body, and guides the main body electrical contact to the cartridge electric contact portion with contacting the main body abutting member when the process cartridge is attached to the main body of the electrophotographic image forming apparatus; and an inclined plane that is provided in an upstream side of the cartridge abutting portion in an attachment direction in which the process cartridge is attached to the main body of the electrophotographic image forming apparatus, and serves to electrically connect the main body electrical contact, guided by the main body abutting member, to the cartridge electrical contact portion when the process cartridge is attached to the main body of the electrophotographic image forming apparatus; and (v) conveying means for conveying the recording medium.

DETAILED DESCRIPTION OF THE PREFERRED EMBODIMENTS

Embodiments of the present invention will be explained on the basis of drawings.

(Embodiment 1)

Figure 1:
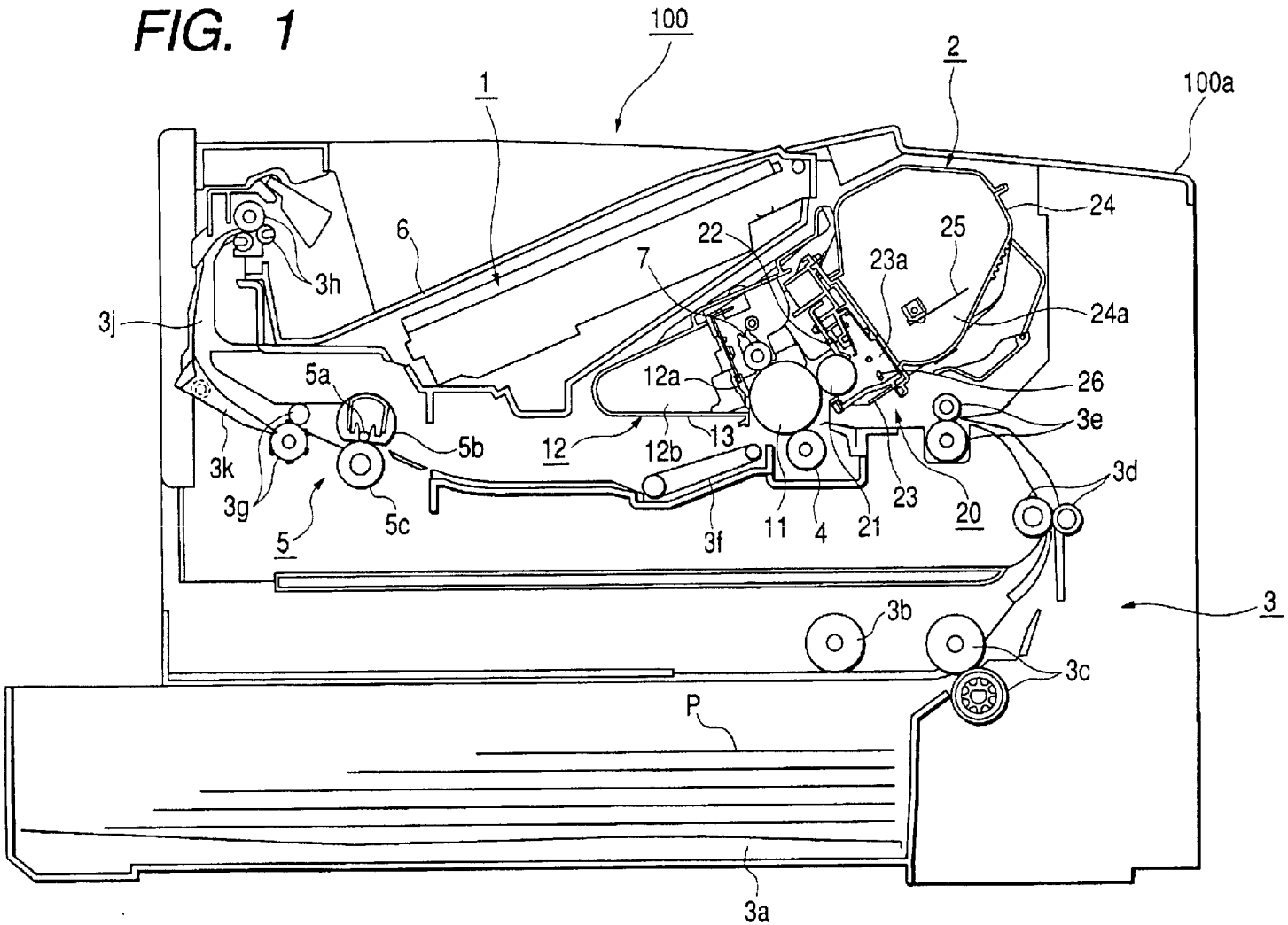
FIG. 1 is a vertical sectional view showing an image forming apparatus according to a first embodiment.

FIG. 1 shows the electrophotographic image forming apparatus according to a first embodiment. This apparatus comprises optical means 1 including a laser diode, a polygon mirror, a lens, and a reflective mirror. The optical means 1 produces a laser beam according to image information. Owing to this, a latent image according to the image information is formed on a photosensitive drum 11 that is an electrophotographic photosensitive body of a process cartridge 2. This latent image is developed by developing means to be made a visible image, i.e., a toner image.

(Whole Structure of Image Forming Apparatus)

Developing means that is one of process means for image formation comprises a developing roller 21 that is a developer bearing body that sends out toner to the photosensitive drum 11, and a developing blade 22 that is a regulating member for regulating the quantity of developer adhering to a surface of the developing roller 21. In addition, by combining the developing roller 21, the developing blade 22, and a development frame body 23 holding them, and a toner container 24 having a toner containing portion 24*a* containing the developer, a developing unit 20 that is a developing apparatus is formed.

The developing frame body 23 has a developing chamber 23*a*, and the toner in the toner containing portion 24*a* adjoining the developing chamber 23*a* is fed to the developing roller 21 in the developing chamber 23*a* by the rotation of a toner feeding member 25. The development frame body 23 comprises a toner agitating member 26, which is rotatable, near the developing roller 21, and circulates the toner in the developing chamber 23*a* fed out from the toner containing portion 24*a*. In addition, since the toner is magnetic toner and the developing roller 21 incorporates a stationary magnet, the toner adheres to the developing roller 21.

Then, the toner is conveyed by rotating the developing roller 21, and frictional charges charged by friction are given by the developing blade 22. In addition, a toner layer of a predetermined thickness is formed on the developing roller 21, and is conveyed to a developing region of the photosensitive drum 11. The toner supplied to this developing region is transferred to the above-described latent image on the above-described photosensitive drum 11, and forms a toner image on the photosensitive drum 11. In addition, the developing roller 21 is connected to a developing bias circuit provided in the main body of the image forming apparatus. Then, a developing bias voltage where a DC voltage is superimposed on an alternating voltage is usually applied.

On the other hand, a feed system 3 conveys a recording medium P, set in a sheet feeding cassette 3*a*, to a transfer position by a pickup roller 3*b*, and a set of conveying rollers 3*c*, 3*d*, and 3*e* in synchronism with the formation of the above-described toner image. A transfer roller 4 serving as transfer means is arranged in the transfer position, and the toner image on the photosensitive drum 11 is transferred to the recording medium P by applying a voltage.

The recording medium P, which is given the transcription of the toner image, is conveyed to fixing means 5 by transportation guide 3*f*. The fixing means 5 comprises a fixing roller 5*b* incorporating a drive roller 5*c* and a heater 5*a*, and fixes the toner image, which is transferred by applying heat and pressure to the passing recording medium P, on the recording medium P.

The recording medium P is conveyed by a pair of discharge rollers 3*g* and 3*h*, and is discharged to a discharge tray 6 via reversing route 3*j*. This discharge tray 6 is provided on an upper surface of the main body of the image forming apparatus. In addition, it is also possible to discharge the recording medium P without passing the reversing route 3*j* by operating a flapper 3*k* that can swing. Thus, convey means comprises the above-mentioned pickup rollers 3*b*, the set of conveying rollers 3*c*, 3*d*, and 3*e*, the conveying guide 3*f*, and the pair of discharge rollers 3*g*, and 3*h*.

After the toner remaining on the photosensitive drum 11 is removed by the cleaning means 12 from the photosensitive drum 11 after the toner image is transferred to the recording medium P by the transferring roller 4, the photosensitive drum 11 is used in a subsequent image formation process. The cleaning means 12 scrapes residual toner on the photosensitive drum 11 by a cleaning blade 12*a* provided in contact with the photosensitive drum 11, and collects the residual toner in a waste toner reservoir 12*b*.

(Structure of Process Cartridge)

Figure 2:
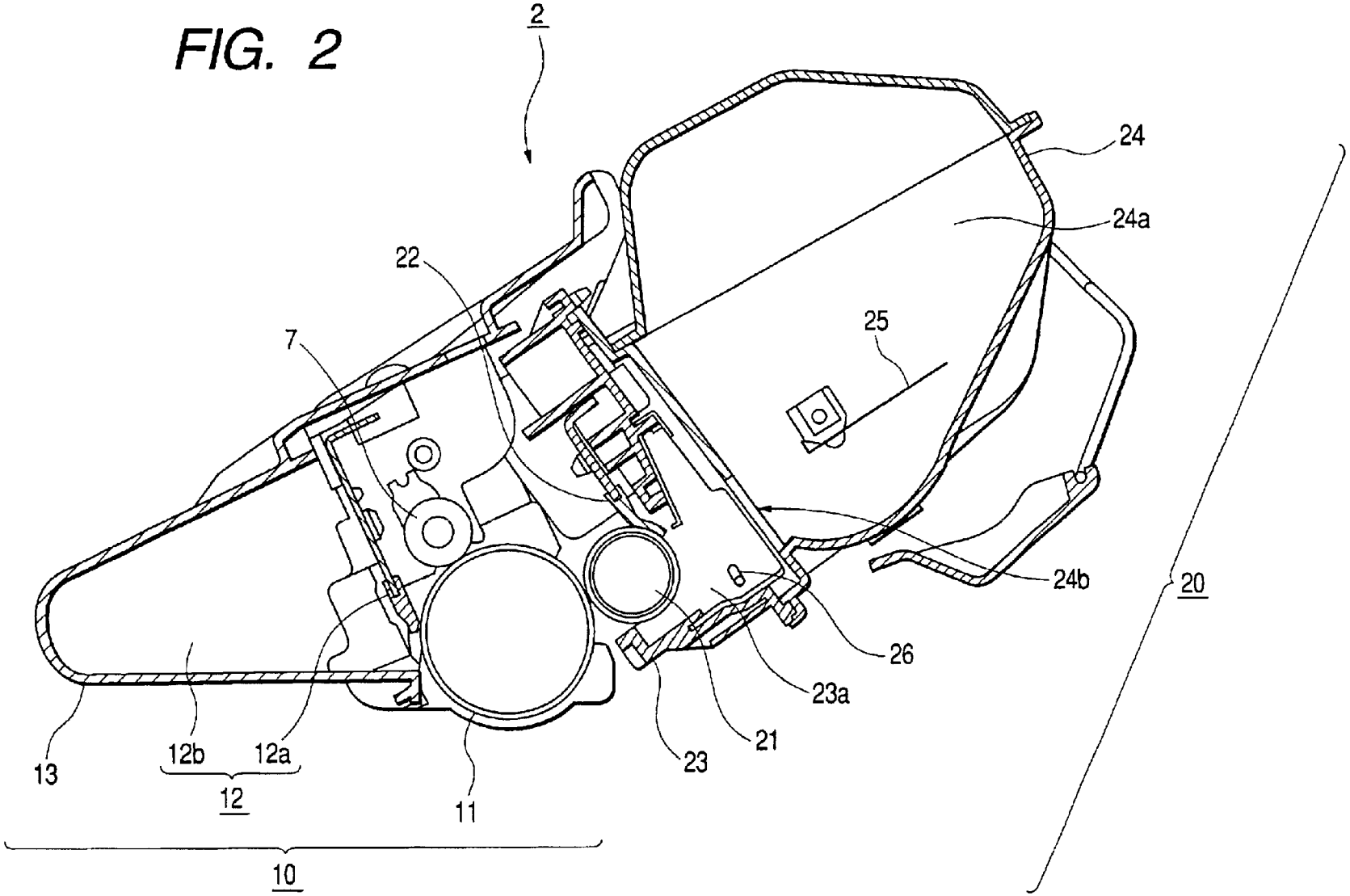
FIG. 2 is a sectional view showing a process cartridge in FIG. 1.

As shown in FIG. 2, the cartridge 2 comprises a developing unit 20 (developing apparatus) by welding and integrating a toner container 24 to a developing frame body 23 that supports the developing roller 21. The toner container 24 comprises a toner containing portion 24*a* that contains the toner, and a toner supplying opening 24*b* for supplying the toner in the toner containing portion 24*a* to the developing chamber 23*a*, and rotatably supports a toner feeding member 25 in the toner containing portion 24*a*. In addition, the toner supplying opening 24*b* is sealed by a developer seal (not shown) until the time when the cartridge 2 is used. Then, the toner becomes available by a user pulling the developer seal out at the first use of the cartridge 2. A developing frame body 23 supports the developing roller 21 and the developing blade 22.

Moreover, a cleaning unit 10 is formed by the process cartridge 2 supporting a cleaning blade 12*a*, the photosensitive drum 11, and a charging roller 7 by a drum frame body 13 that is a frame body.

Then, the cartridge 2 is made to be a cartridge by integrating the above-mentioned developing unit 20 and cleaning unit 10.

Figure 3:
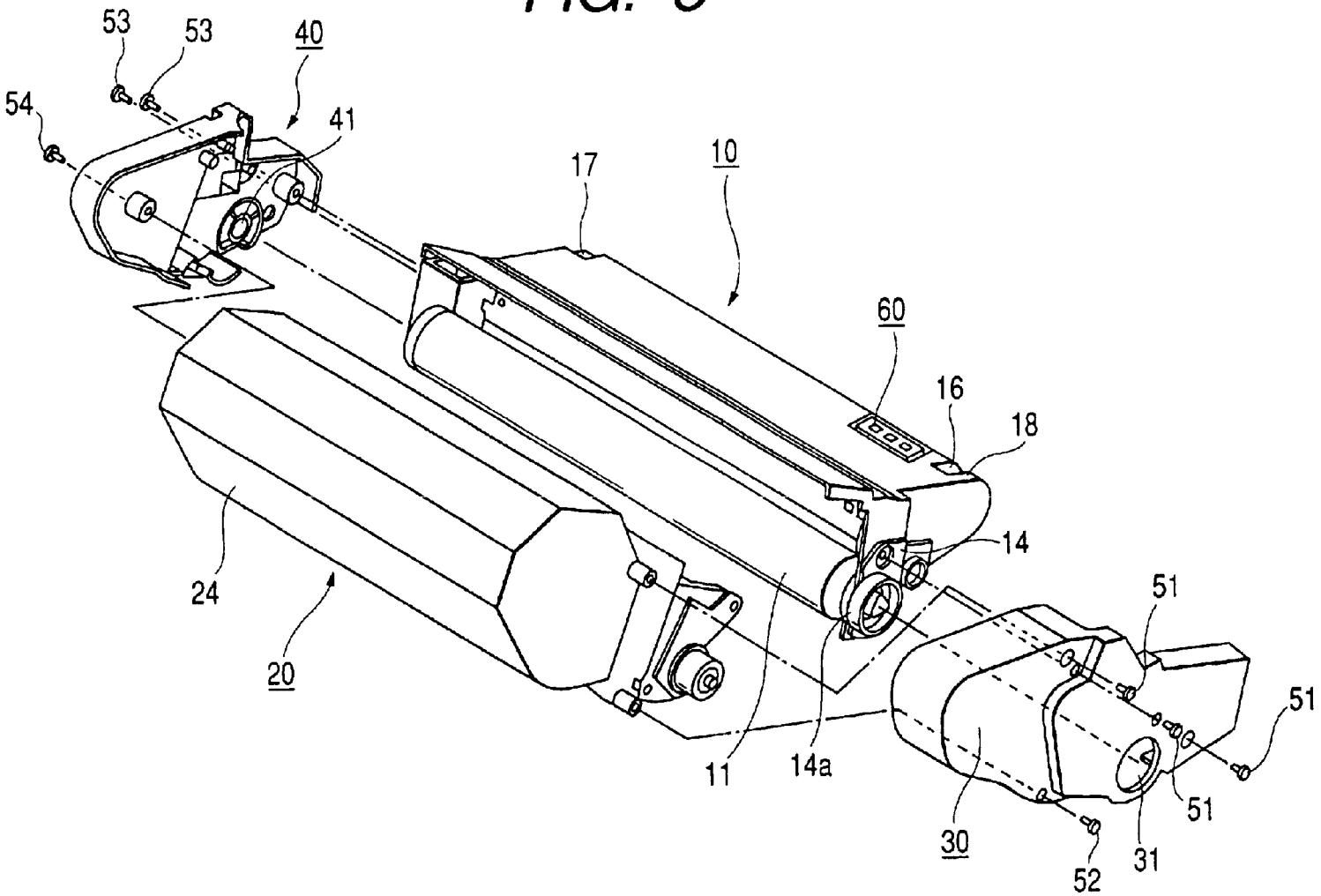
FIG. 3 is an exploded perspective view showing the process cartridge in FIG. 2.
Figure 4:
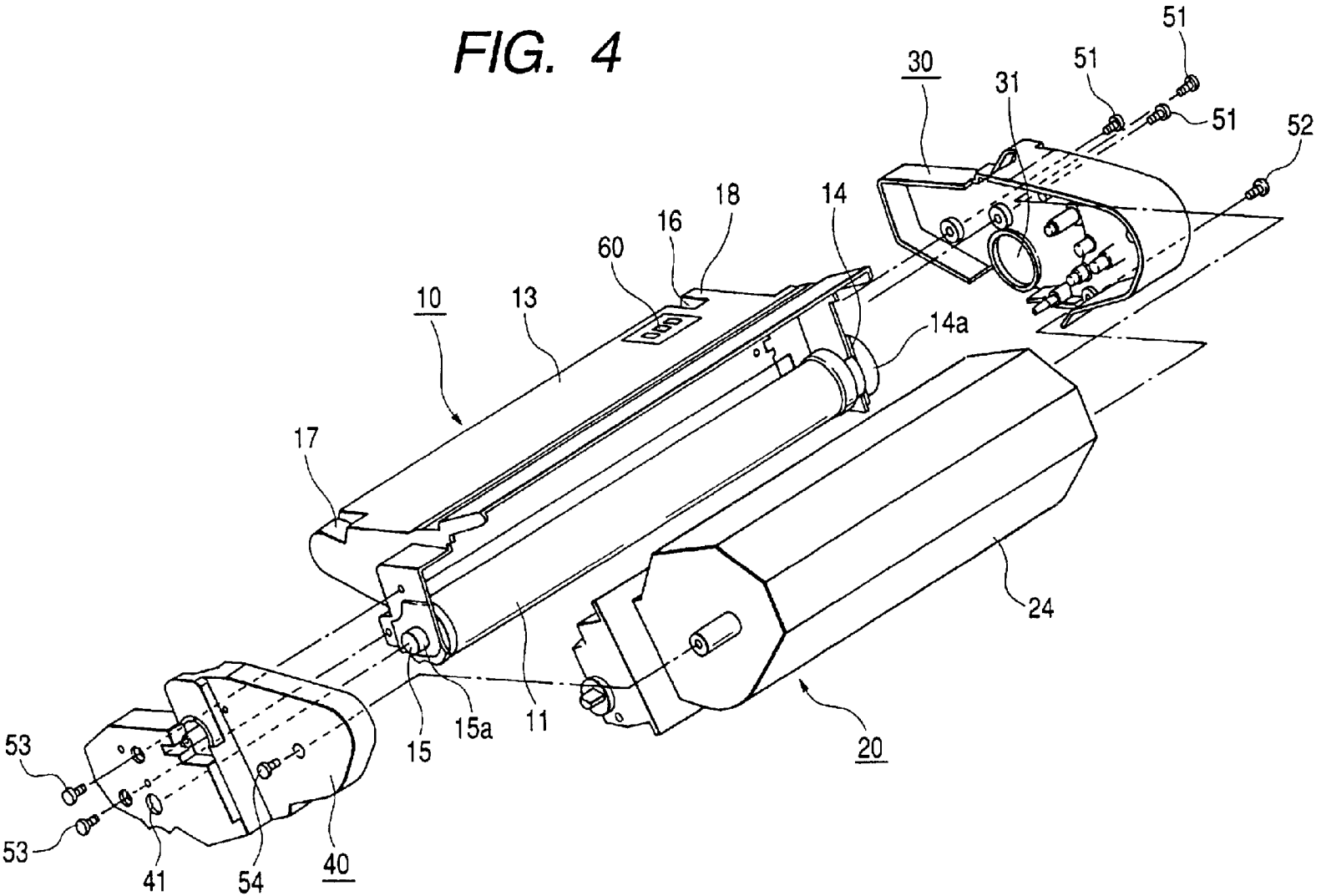
FIG. 4 is an exploded perspective view with decomposing the process cartridge in FIG. 2 and viewing it from another direction.
Figure 5:
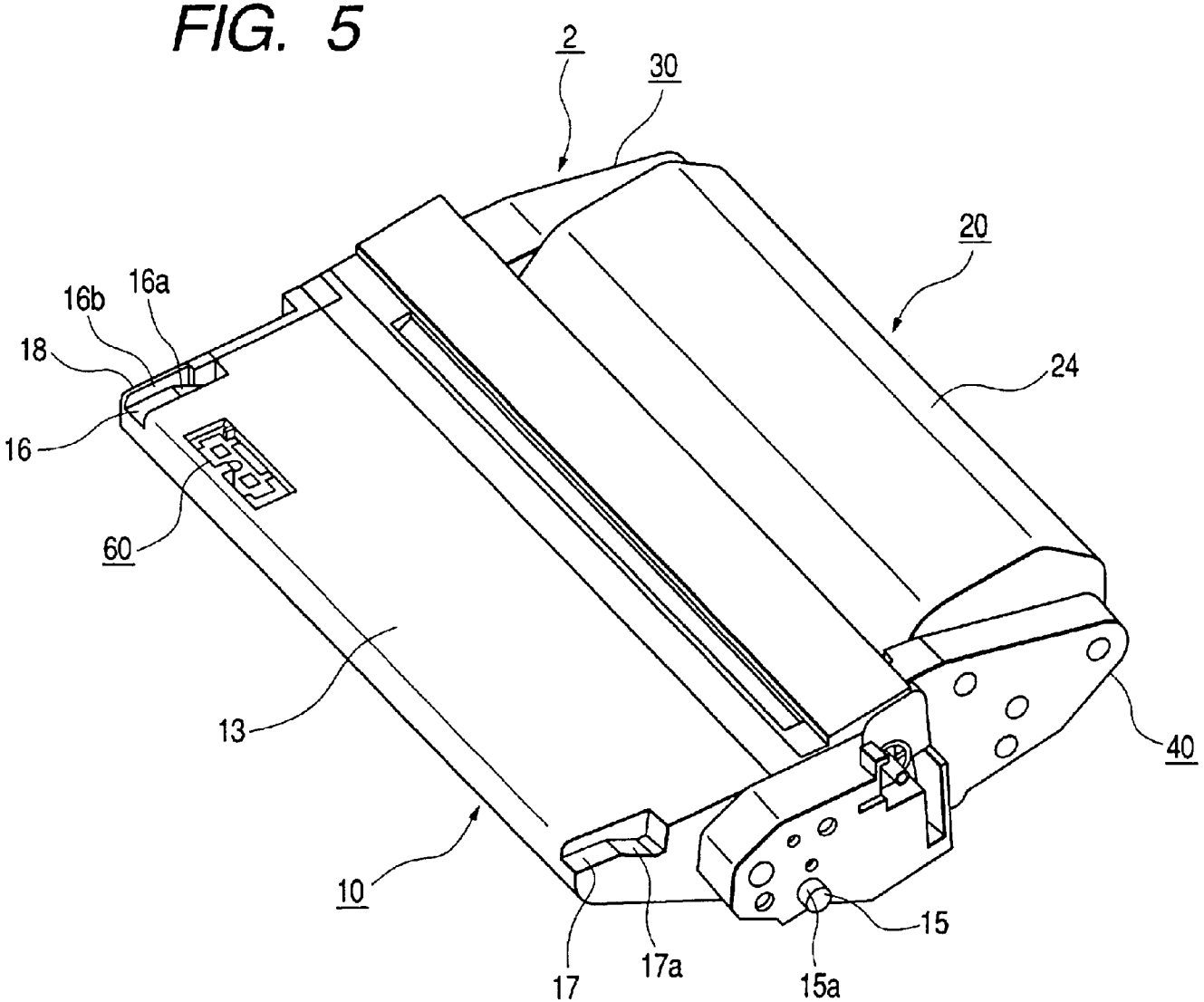
FIG. 5 is a perspective view in view of the process cartridge in FIG. 2 from a left side.

Each gear flange is installed in both ends of the photosensitive drum 11 as shown in FIG. 3, one gear flange is rotatably supported by a drum bearing 14, and another gear flange is rotatably supported by a drum shaft 15 as shown in FIG. 4. Then, the drum bearing 14 and drum shaft 15 are installed in a drum frame body 13, and constitute the cleaning unit 10.

(Coupling of Cleaning Unit and Developing Unit)

Next, the structure of coupling the cleaning unit 10 and developing unit 20 will be explained. The cleaning unit 10 and developing unit 20 are coupled by side covers 30 and 40 on both sides respectively as shown in FIGS. 3 and 4. One side cover 30 is positioned with the cleaning unit 10 by engaging a reference hole 31 with a cylindrical portion 14*a* of the drum bearing 14, and is fixed with screws 51. The developing unit 20 is positioned by engaging a reference boss of the side cover 30 with a reference hole of the developing unit 20, and is fixed with screws 52 as well as the above.

Another side cover 40 is positioned with the cleaning unit 10 by engaging a reference hole 41 with a cylindrical portion 15*a* of the drum shaft 15 of the photosensitive drum 11, and is fixed with screws 53. Moreover, the developing unit 20 is fixed by screws 54 as well as the other side.

(Structure of Attachment Means of Process Cartridge)

Figure 15:
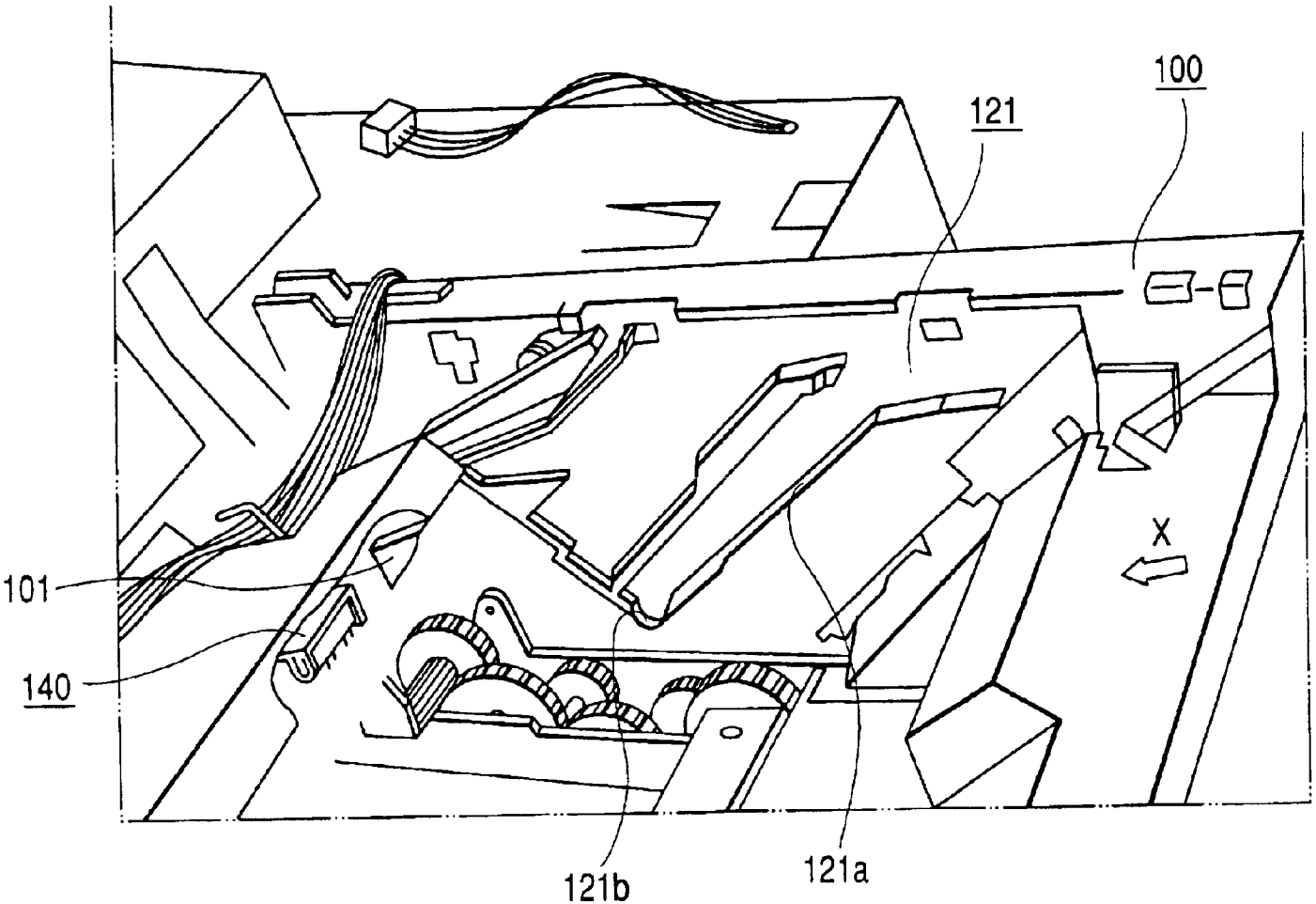
FIG. 15 is a perspective view showing attachment guide means in the right side of a main body of an image forming apparatus.
Figure 16:
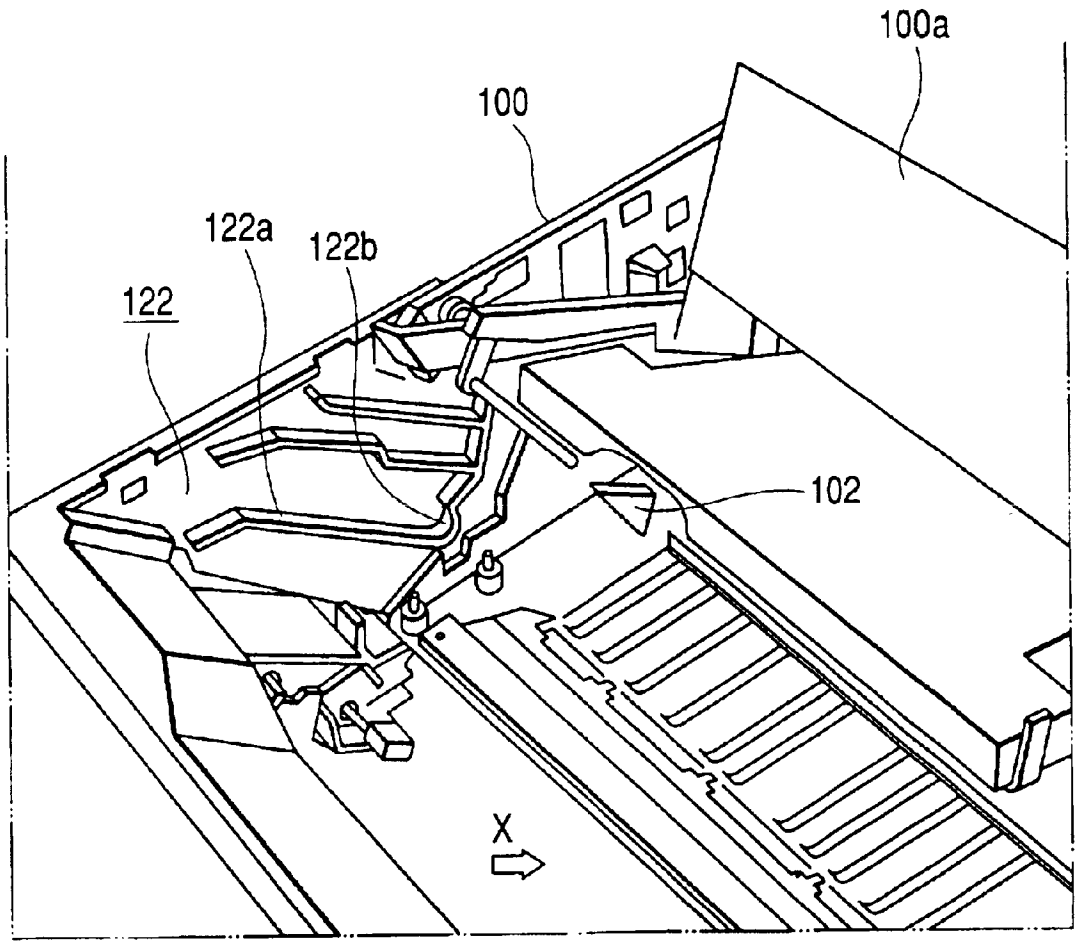
FIG. 16 is a perspective view showing attachment guide means in the left side of a main body of an image forming apparatus.

Next, attachment guide means at the time when the cartridge 2 is attached to or detached from a main body 100 on the basis of FIGS. 15 and 16 is discussed. FIG. 15 is a perspective view showing a part of the main body 100 located in the right side of the developing unit 20 when viewed from an attachment direction (direction shown by an arrow X) in which the cartridge 2 is attached to the main body 100. Moreover, FIG. 16 is a perspective view showing a part of the main body 100 located in the left side of the developing unit 20 similarly.

In both external surfaces of the cleaning unit 10, a guide member of a cartridge side at the time when the cartridge 2 is attached to or detached from the main body 100 is defined by an exterior of the cylindrical portion 14*a* of the drum bearing 14, and an exterior of the cylindrical portion 15*a* of the drum shaft 15 that are shown in FIGS. 3 and 4.

Figure 6:
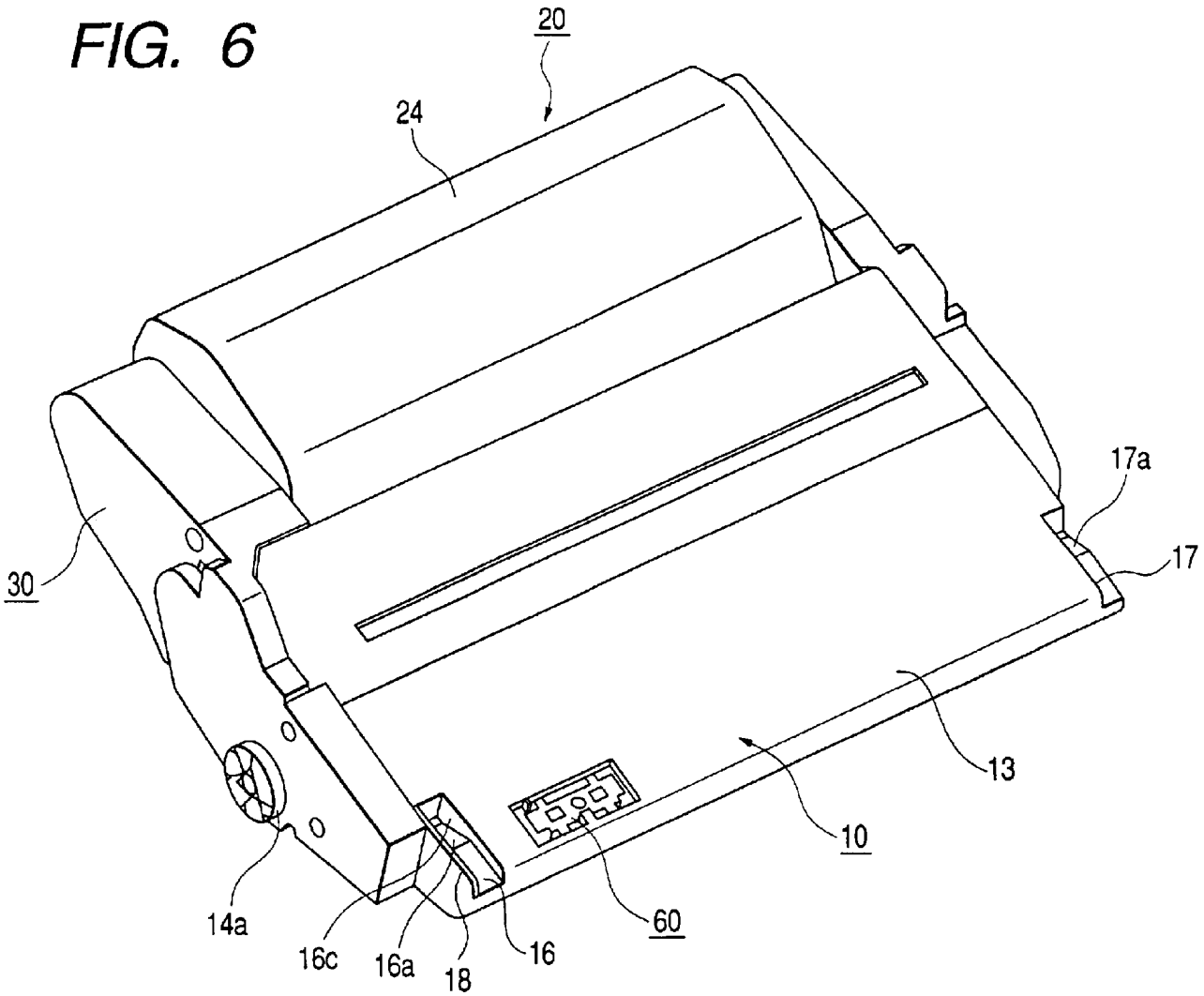
FIG. 6 is a perspective view in view of the process cartridge in FIG. 2 from a right side.

As shown in FIG. 3 or FIG. 6, on an upper surface of the drum frame body 13 constituting the cleaning unit 10 that is a main body of a process cartridge (main body of a unit), that is, a surface located in an upper side at the time when the cartridge 2 is attached to the main body 100, regulating and abutting portions 16*a* and 17*a* that are rotation regulating and abutting portions are provided in edges in the longitudinal direction orthogonal to the attachment direction of the process cartridge, respectively. Both regulating and abutting portions 16*a* and 17*a* are provided in each bottom of ends of grooves 16 and 17 that are attachment guide portions (groove portions) extending in the above-mentioned attachment direction. Then, they regulate the rotary position of the cartridge 2 when the cartridge 2 is attached to the main body 100.

That is, when the cartridge 2 is attached to the main body 100, as shown in FIGS. 15 and 16, the above-mentioned regulating and abutting portions 16*a* and 17*a* abut on the top points of fixed members 101 and 102 that are main body rotation-regulating members provided in the main body 100 of the image forming apparatus, respectively. Then, the rotary position of the cartridge 2 with centering the cylindrical portion 14*a* of the drum bearing 14 and the cylindrical portion 15*a* of the drum shaft 15 is regulated.

Next, a guide wall provided in the main body 100 will be described. When an opening and closing member 100*a* of the main body 100 shown in FIG. 1 is rotated counterclockwise around a fulcrum, an upper portion of the main body 100 is opened. FIGS. 15 and 16 are partial perspective views showing attachment guide means to the main body 100 in both right and left ends of the cartridge 2. That is, as mentioned above, FIG. 15 shows a right side in the attachment direction of the cartridge 2 (X direction) when viewing both inner walls of the main body 100 from an opening generated by opening the opening and closing member 100*a*, and FIG. 16 shows a left side.

A guide member 121 (attachment means) is arranged in the right inner wall of the main body 100 as shown in FIG. 15, and a guide member 122 (attachment means) shown in FIG. 16 is formed in the left inner wall.

The guide members 121 and 122 comprise guide parts 121*a* and 122*a* that are obliquely installed so as to be declining toward the front in view of the direction shown by an arrow X, that is the inserted direction (attachment direction) of the cartridge 2, respectively. Moreover, they connect to the guide members 121 and 122, respectively. They comprise positioning grooves 121*b* and 122*b* that are semicircular attachment positions with which the cylindrical portion 14*a*, that is a positioning member of the drum bearing 14 of the cartridge 2, and a cylindrical portion 15*a*, that is a positioning member of the drum shaft 15, are just engaged. These positioning grooves 121*b* and 122*b* have cylindrical surrounding walls. The centers of these positioning grooves 121*b* and 122*b* coincide with centers of the cylindrical portion 14*a* of the drum bearing 14 of the cartridge 2, and the cylindrical portion 15*a* of the drum shaft 15, respectively, when the cartridge 2 is attached to the main body 100, and also coincide with a central axis that is a shaft line of the photosensitive drum portion 11.

The width of guide members 121 and 122 has width at which the cylindrical portion 14*a* of the drum bearing 14 and the cylindrical portion 15*a* of the drum shaft 15 loosely engage in view of the attachment direction of the cartridge 2. Then, the cylindrical portion 14*a* of the drum bearing 14 of the cartridge 2 and the cylindrical portion 15*a* of the drum shaft 15 engage with the positioning grooves 121*b* and 122*b* of the guide members 121 and 122 of the main body 100, respectively, when the cartridge 2 is attached to the main body 100. Moreover, regulating and abutting portions 16*a* and 17*a* in both sides of the drum frame body 13 of the cartridge 2 abut on points of the fixed members 101 and 102 of the main body 100.

(Structure of Laser Shutter)

Figure 17:
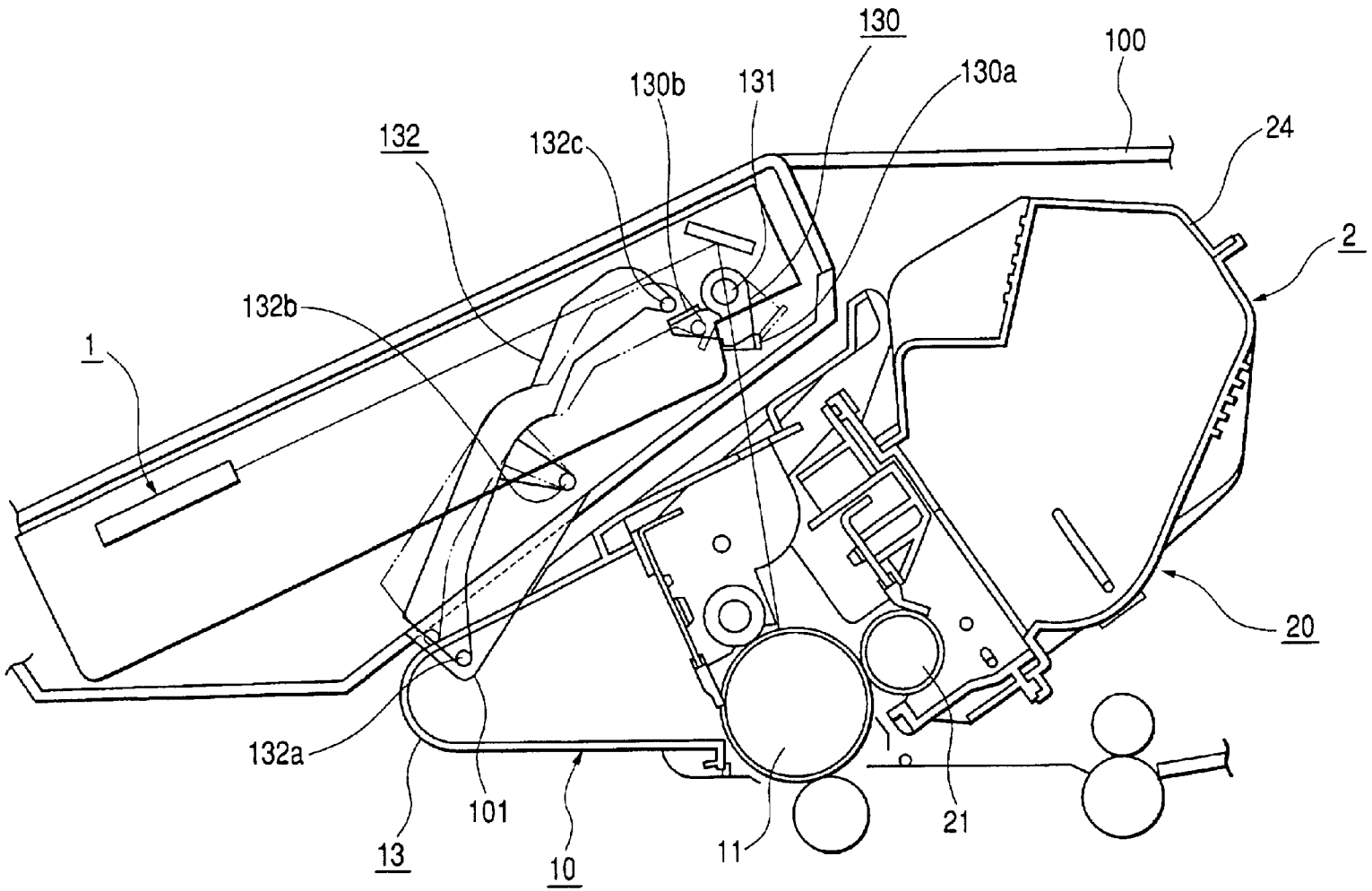
FIG. 17 is an explanatory diagram of a laser shutter.

A shutter 130 that is an exposure optical shield member to shield a laser beam path is provided for a laser beam so that laser light does not to leak from the optical means 1 when the cartridge 2 is not attached to the main body 100 as shown in FIG. 17.

Figure 19:
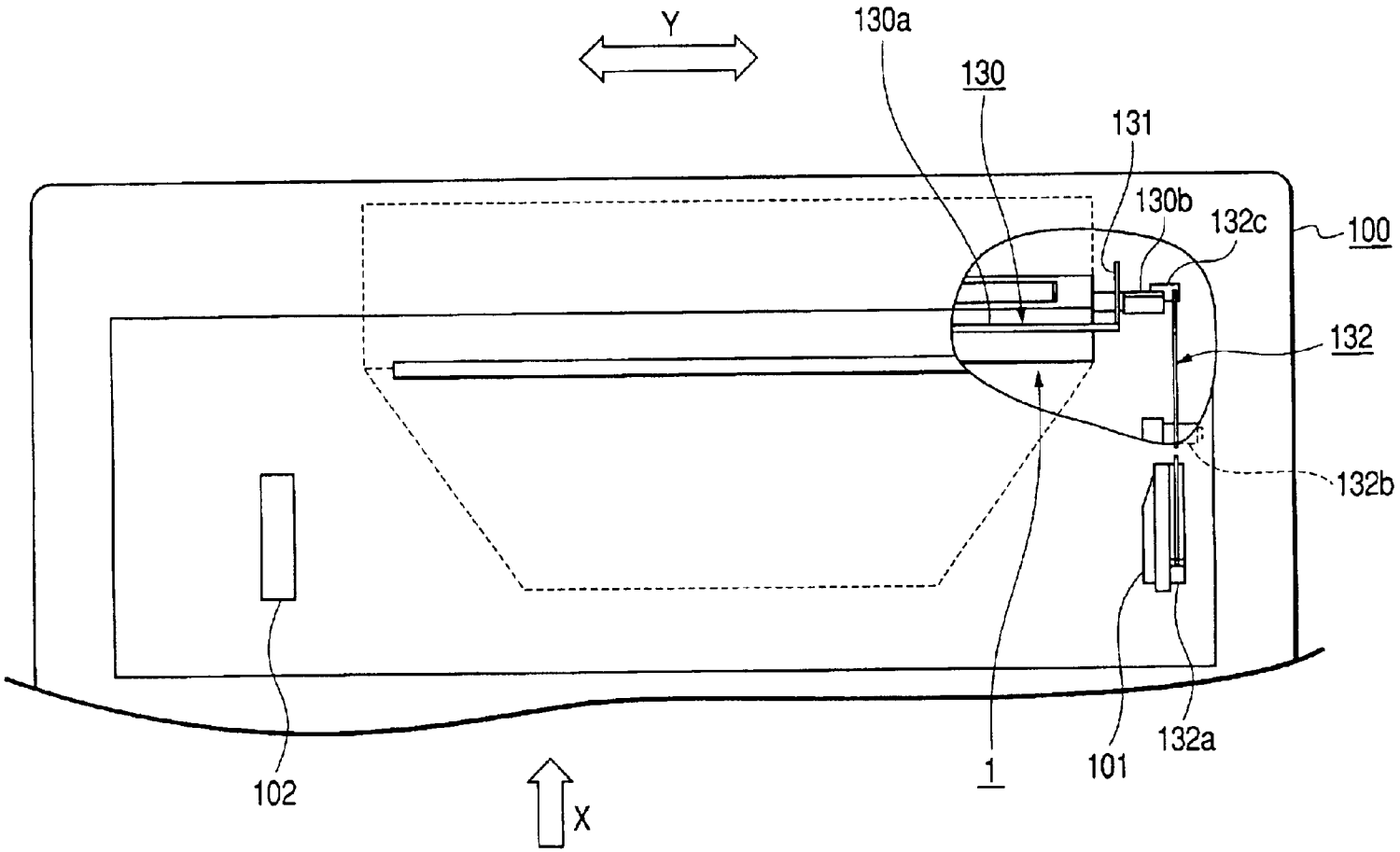
FIG. 19 is an explanatory diagram of the allocation of a laser shutter, and is a perspective view showing the allocation of a connector, a connector holder, and a memory tag.

The shutter 130 is provided in the main body 100 of the image forming apparatus by a spindle (not shown), etc., so as to be rotatable around a shutter fulcrum 131. A shutter link 132 to rotate the shutter 130 is rotatably provided in the main body 100 by a bearing (not shown), etc. In addition, as shown in FIG. 19, this link 132 is arranged between the fixed member 101, to which the regulating and abutting portion 16*a* of the drum frame body 13 contacts, and a right sidewall of the main body 100 when the cartridge 2 is attached, in the Y direction orthogonal to the attachment direction (direction from the front to the interior in the figure) of the cartridge 2 shown by an arrow X. Moreover, an abutting portion 132*a* of the link 132 is arranged in an internal side of the fixed member 101 in the attachment direction of the cartridge 2.

Next, the operation of the shutter 130 and the link 132 will be explained.

Figure 18:
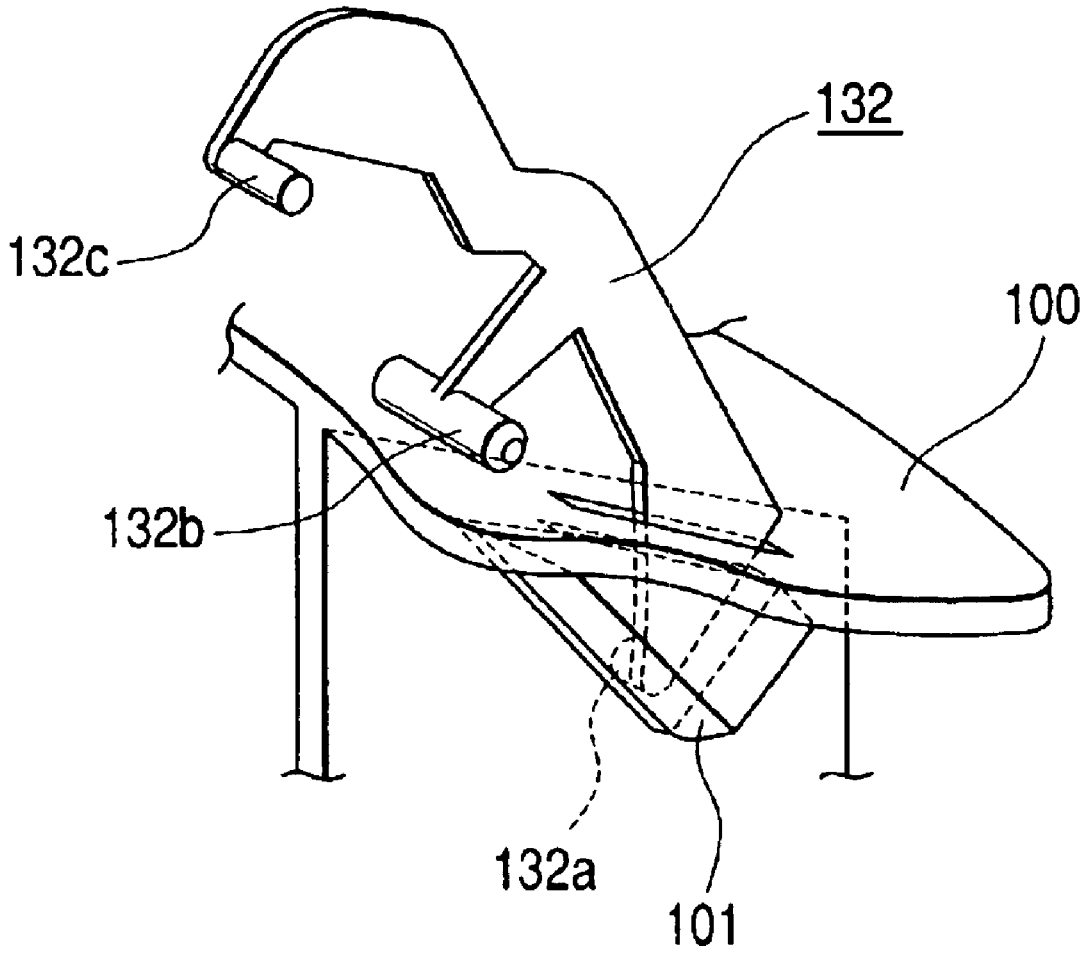
FIG. 18 is an explanatory diagram of a drive portion of the laser shutter.

When the cartridge 2 is not attached to the main body 100, the shutter 130 is energized in the clockwise direction in FIG. 17 around the shutter fulcrum 131 by a spring and the like (not shown). Then, the shutter portion 130*a* shields the laser path in the position of contacting the optical means 1. Then, a rib 18 that is a wall member of the groove 16 of the drum frame body 13 abuts on the abutting portion 132*a* of the link 132 as a driving member in the process where the cartridge 2 is attached to the main body 100 (refer to FIGS. 4 and 18). Thus, the link 132 rotates clockwise in FIG. 17 around a spindle 132*b* when the rib 18 of the drum frame body 13 of the cartridge 2 and the abutting portion 132*a* abut.

At this time, a boss 132*c* of the link 132 is pushed by contacting the abutting portion 130*b* of the shutter 130. As a result, the shutter 130 rotates counterclockwise around the shutter fulcrum 131, and removes the shutter portion 130*a* from the laser beam path.

As a consequence, when the cartridge 2 is attached in a predetermined position in the main body 100, it is possible to surely irradiate the photosensitive drum 11 with the laser beam since the laser beam path is not shielded by the shutter portion 130*a* of the shutter 130.

(Structure of Memory Tag)

Figure 7:
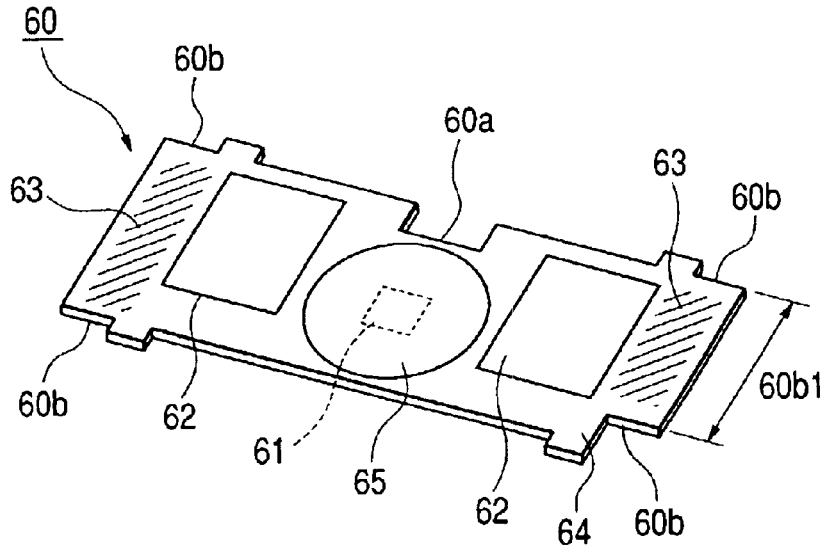
FIG. 7 is a perspective view showing a memory tag.
Figure 8:
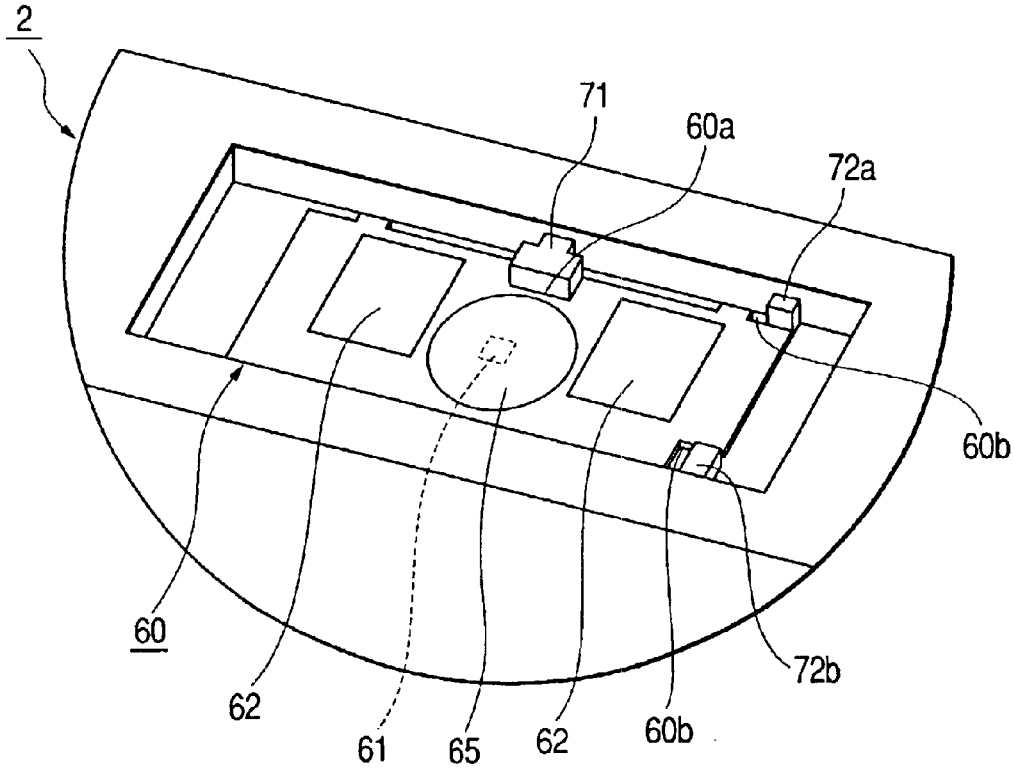
FIG. 8 is a perspective view showing a state where a memory tag is attached to a process cartridge.

A memory tag 60 that is a main board is installed on a surface of the drum frame body 13 of the cartridge 2 as shown in FIG. 3 to FIG. 6. As shown in FIGS. 7 and 8, the memory tag 60 is a plate-like member where a memory element 61, a contact portion 62 that is a cartridge electrical contact portion, and an abutting portion 63 on which a bumping portion 141 of the connector 140 described later abuts are arranged on a board 64 (printed board) (refer to FIG. 13). Here, the contact portion 62 is made of conductive material, and is connected to the memory element 61 electrically.

The memory element 61 is arranged at the center, and is protected by a coating layer 65 (protective portion) with a resin. Moreover, contact portions 62 are coplanar with the coating layer 65 that protects the memory element 61, and, are arranged on both sides of the memory element 61. Moreover, in the vicinity of the contact portions 62, the abutting portion 63 on which the bumping portion 141 of the connector 140 shown in FIG. 13 abuts is arranged in parallel.

Figure 13:
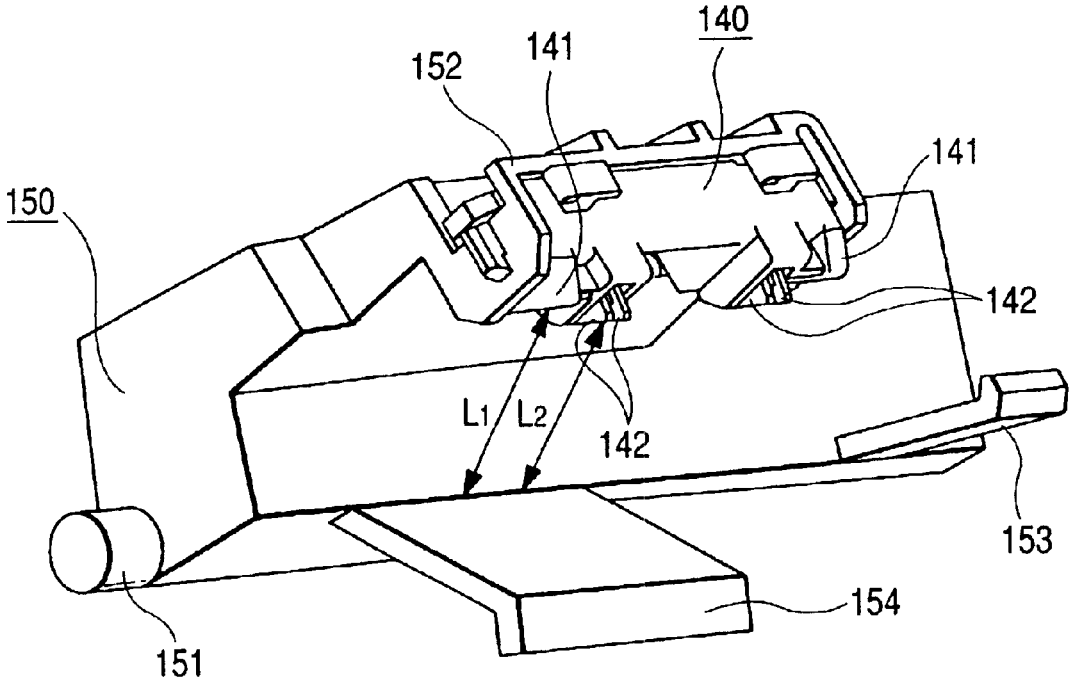
FIG. 13 is a perspective view showing a connector.
Figure 14:
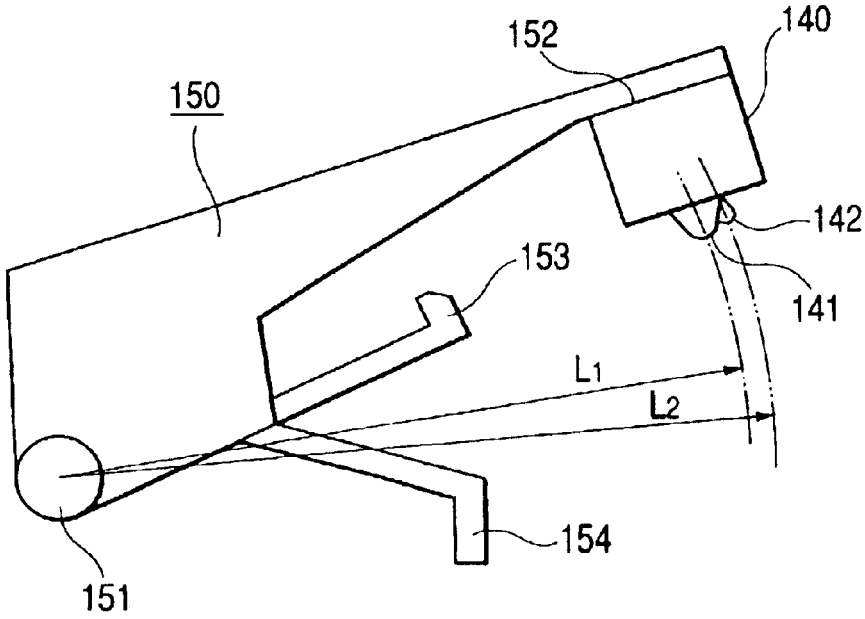
FIG. 14 is a side view showing a connector.

As shown in FIGS. 13 and 14, a metallic electrical contact 142 (main body electrical contact) generating contact pressure is provided in the connector 140. Then, when the bumping portion 141 abuts on the main body abutting portion 63 of the memory tag 60, the deflection of the electrical contact 142 becomes constant, and it is possible to make the contact pressure to the contact portion 62 of the memory tag 60 be a desired contact pressure, and hence, it is possible to stabilize the electrical connection.

Moreover, dimensional precision in the height direction of the abutting portion 63 and contact portion 62 in the memory tag 60 is improved by making the abutting portion 63 of memory tag 60 be flush with the contact portion 62. As a result, it becomes possible to further stabilize the contact pressure of the electrical contact 142 of the connector 140.

In addition, the contact portion 62 is provided in both sides of the coating layer 65 (preventive portion) protecting the memory element 61 of the memory tag 60, and the abutting portion 63 is flatly arranged so as to be on the extension of both contact portions 62 and to be adjacent to the contact portion 62.

Since distance L1 to the bumping portion 141 of the connector 140 and distance L2 to the electrical contact 142 from a rotation axis 151 of a connector holder 150 that are shown in FIGS. 13 and 14 can be almost equated by providing the abutting portion 63 like this, the contact pressure of the electrical contact 142 is hardly influenced by dimensional dispersion of the height of the bumping portion 141, and hence, can be stabilized.

In addition, since the abutting portion 63 of the memory tag 60 is arranged in parallel to the contact portion 62 and the distances to the bumping portion 141 and the electrical contact 142 of the connector 140 are almost equal, the pressure balance becomes uniform, and hence, it is possible to prevent a continuity failure due to a contact pressure shortage of the contact portion 62 and the like.

Next, the installation structure of the memory tag 60 will be explained.

As shown in FIGS. 7 and 8, a concave groove portion 60*a* is provided in the longitudinal direction in a space with the contact portions 62 on one side edge of the memory tag 60. Then, the rib 71 that is a contact positioning portion orthogonal to the longitudinal direction of the memory tag 60 is formed in the cartridge 2, and positioning in a longitudinal direction is performed by engaging the groove portion 60*a*, which is a notched portion of the memory tag 60, with the rib 71. In addition, in a cross direction, positioning by width size 60*b*1 is performed by bumping a bumping portion 60*b* of the memory tag 60 to positioning portions 72*a* and 72*b* of the cartridge 2.

Figure 9:
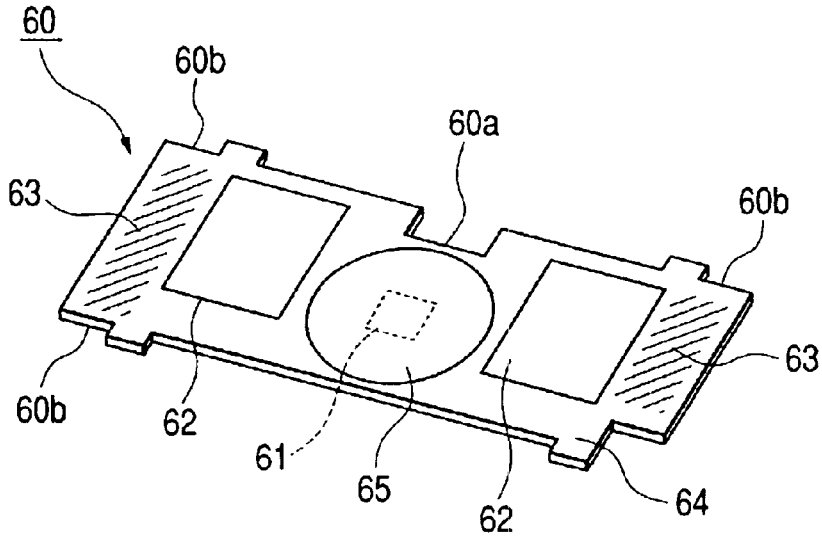
FIG. 9 is a perspective view showing a memory tag.
Figure 10:
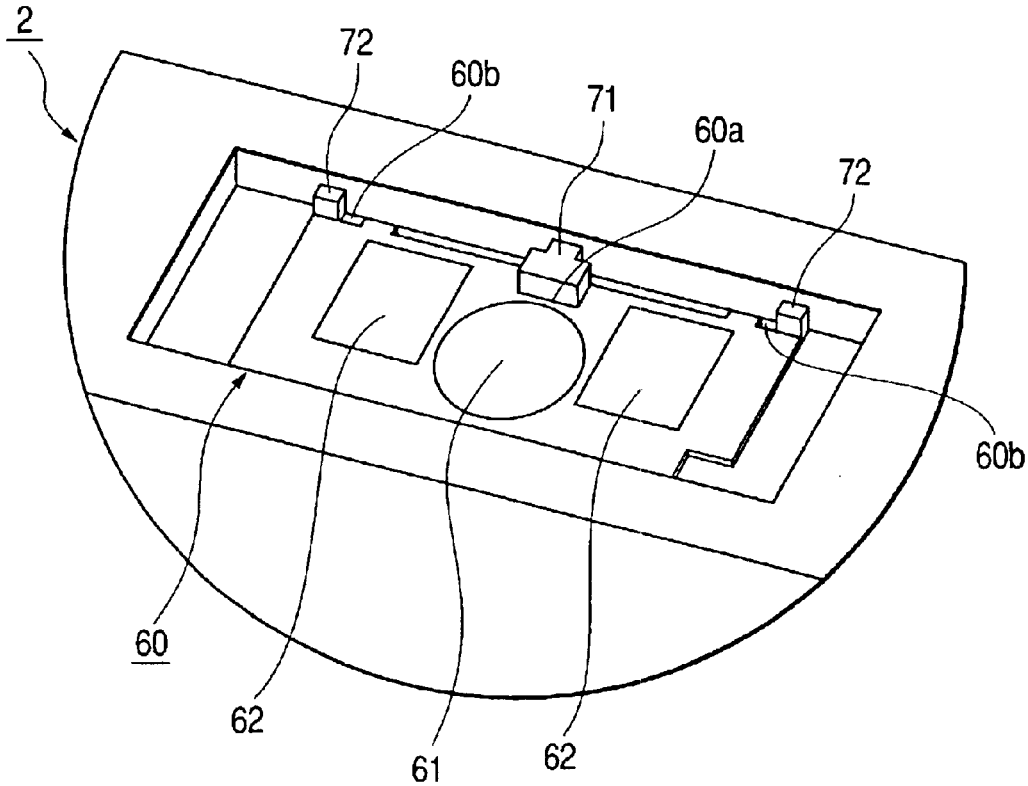
FIG. 10 is a perspective view showing a state where a memory tag is attached to a process cartridge.

Moreover, positioning in the cross direction can be also performed by bumping the bumping portion 60*b* of the memory tag 60 to the positioning portion 72 of the cartridge 2 as shown in FIGS. 9 and 10. Positioning by bumping can achieve positioning in the cross direction even if the drawing direction of a molding die for a mounting portion of the memory tag 60 in the cartridge 2 is not parallel to a surface including the contact portion 62 of the memory tag 60.

The above positioning by bumping can achieve positioning in the cross direction even if the drawing direction of a molding die for a mounting portion of the memory tag 60 in the cartridge 2 is not parallel to a surface including the contact portion 62 of the memory tag 60. Therefore, it is possible to use the molding die for two or more products since the structure of the molding die does not control the positioning of the memory tag 60 in the longitudinal direction and the cross direction positioning, and hence, it is possible to plan a cost reduction due to the advantage of mass production.

In addition, if a positioning form is a hole (round hole or rectangular hole), the memory tag becomes large. However, the enlargement of the memory tag can be suppressed by making the form a concave notch as mentioned above.

Moreover, if the positioning form is a hole (round hole or rectangular hole), there is a possibility of a wrench when a positioning hole and a positioning boss engage. In particular, since a board of about 0.6 mm thick is used in this embodiment, the possibility of the wrench is large. However, if the form is made to be concave as mentioned above, there is not a possibility of the wrench, and assembly property further improves.

Next, the structure of the connector arranged in the main body 100 will be explained.

As shown in FIG. 13, in the connector 140, one or two metallic main body electrical contacts 142 generating contact pressure by elastic deformation are arranged per contact portion 62 of the memory tag 60. In sides of the electrical contact 142, the bumping portions 141 abutting on the abutting portion 63 of the memory tag 60 are provided in the vicinity of both sides in the longitudinal direction respectively. In the opposite side of a contact portion of the electrical contact 142 to the memory tag 60, a lead wire is connected to a control unit (not shown) of the main body 100.

The connector holder 150 comprises a rotation axis 151, a connector mounting portion 152, a longitudinal positioning lever 153 to position the connector 140, and an abutting rotation lever 154.

Figure 12:
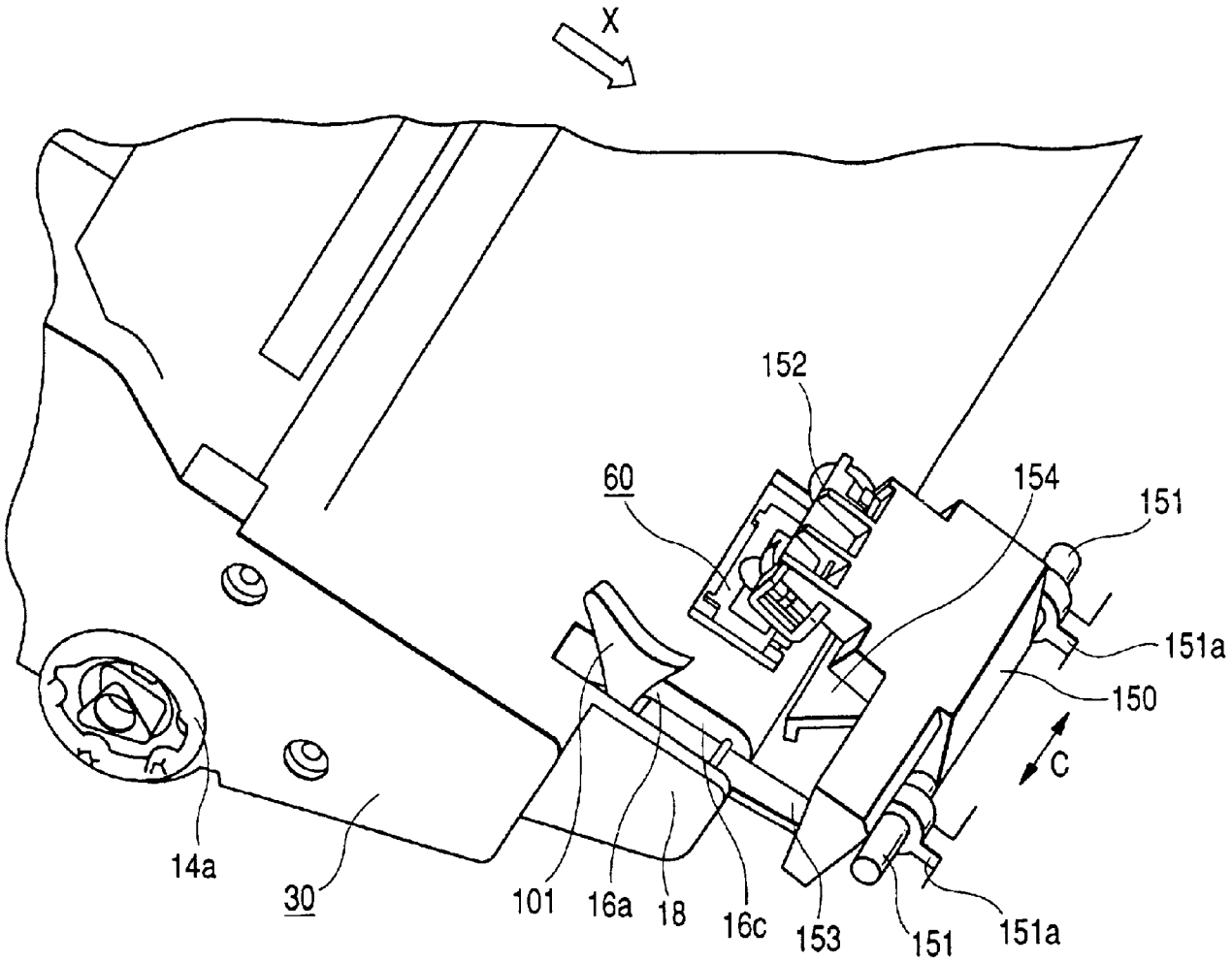
FIG. 12 is an enlarged perspective view showing the allocation of a memory tag and a connector.

The connector 140 is fixed to the connector holder 150 with snap fitting or screws, etc. (not shown). In addition, the connector holder 150 rotates on the rotation axis 151 as previously stated, and as shown in FIG. 12, the rotation axis 151 is slidably supported in the longitudinal direction (direction shown by an arrow C) by a bearing 151*a* in the main body 100.

Next, the energized connection of the connector 140 and memory tag 60 will be explained according to the attachment operation of the cartridge 2 to the main body 100.

The regulating and abutting portion 16*a* in the right side of the cartridge 2 is provided in the groove 16 that is an attachment guide portion that has a wall member composed of the rib 18 that opens or closes the shutter 130 that is a laser beam shield member (exposure optical shield member) of the main body 100. In addition, the left regulating and abutting portion 17*a* is provided in the groove 17 that is an attachment guide portion whose outside is opened. As shown in FIG. 12, when the cartridge 2 is inserted into the main body 100 in the direction shown by an arrow X, the fixed member 101 in the main body 100 is led in between the cartridge attachment guide portions 16*b* and 16*c* (walls) of the groove 16 of the cartridge 2 during insertion (refer to FIGS. 5 and 6), and hence, guide the cartridge 2 in the direction orthogonal to the attachment direction of cartridge 2. A longitudinal positioning lever 153 that is a main body support member positioning portion of the connector holder 150 that is a main body electrical contact supporting member that is arranged movably in the longitudinal direction (above-mentioned orthogonal direction) enters in between end portions 16*b* and 16*c* of the point of the above-mentioned groove 16, when the cartridge 2 is further inserted. Then, the connector 140 is positioned in the longitudinal direction to the cartridge 2.

Figure 11:
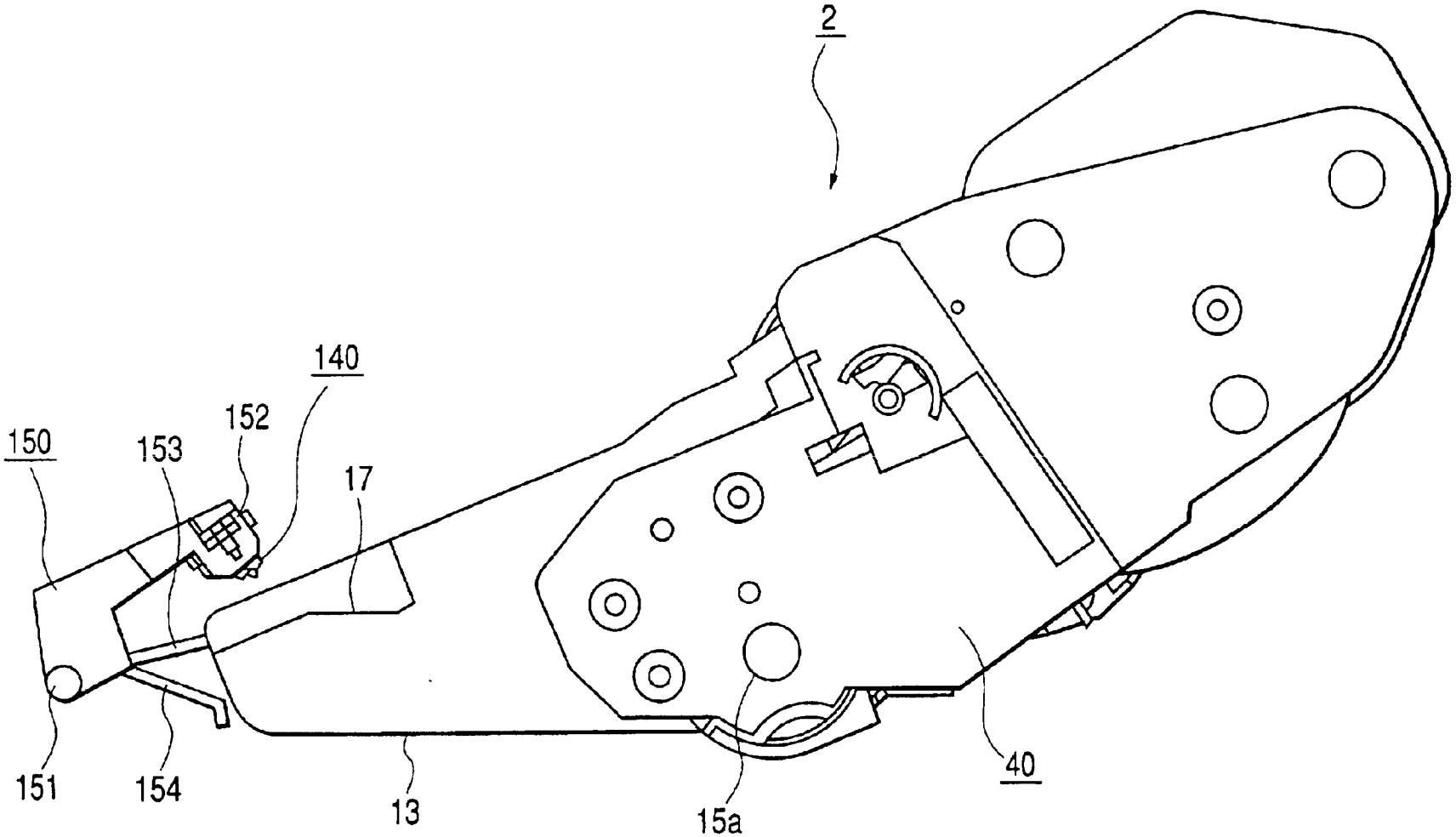
FIG. 11 is a side view showing the allocation of a memory tag and a connector.

That is, the walls 16*b* and 16*c* of the groove 16 that is the above-mentioned attachment guide portion are cartridge attachment guide portions to guide the cartridge 2 in the direction orthogonal to the attachment direction. In addition, the walls 16*b* and 16*c* are cartridge supporting member positioning portions to perform the positioning of the connector 140 in the longitudinal direction that has the electrical contact 142 for the cartridge 2. Moreover, a bottom portion 16*a* of the groove 16 is a rotation-regulating and abutting portion that abuts on the fixed member 101, which is a main body rotation regulating-portion, and regulates the rotation of the cartridge 2. Therefore, the miniaturization of the cartridge 2 becomes possible. In addition, since the fixed member 101 that is a main body rotation regulating-portion is also a main body cartridge attachment guide portion that performs guidance in the direction orthogonal to the attachment direction of the cartridge 2, the miniaturization of the main body of the apparatus becomes also possible. Moreover, since the cartridge 2 abuts on the rotation lever 154 of the connector holder 150 when the cartridge 2 is inserted, the connector 140 rotates toward the memory tag 60 around the rotation axis 151 of the connector holder 150(clockwise in FIG. 11).

Then, the cylindrical portion 14*a* of the drum bearing 14 of the cartridge 2 and the cylindrical portion 15*a* of the drum shaft 15 reach the positioning grooves 121*b* and 122*b* of the main body 100 (refer to FIGS. 15 and 16).

In the cartridge 2, when the central line that connects the center of the cylindrical portion 14*a* of the drum bearing 14 to the cylindrical portion 15*a* of the drum shaft 15 is kept horizontally in sides of the cleaning unit 10 and developing unit 20, weight is distributed so that the side of the developing unit 20 may have a larger primary moment than the side of the cleaning unit 10. Hence, the cartridge 2 rotates clockwise on a line connecting the cylindrical portion 14*a* of the drum bearing 14 and the cylindrical portion 15*a* of the drum shaft 15, the regulating and abutting portions 16*a* and 17*a* of the cartridge 2 abut on points of the fixed members 101 and 102, and the insertion operation of the cartridge 2 is completed. In addition, the connector 140 abuts the memory tag 60 at the same time.

As previously stated, by arranging the groove 16 near the memory tag 60 of the cartridge 2 and positioning the connector holder 150, where the connector 140 of the main body 100 is installed, by the walls 16*b* and 16*c* that are cartridge supporting member positioning portions of the groove 16, it is possible to make the contact portion 62 of the memory tag 60 and the connector 140 accurately abut and to maintain this state. Owing to this, it is possible to prevent the contact shift of the memory tag 60, and to plan the miniaturization of the connector unit.

Moreover, the above-mentioned groove 16 can reduce the width of the movable range of the connector unit in the longitudinal direction since the groove 16 also serves as the cartridge attachment guide portion in the direction orthogonal to the attachment direction when the cartridge 2 is attached to the main body 100, and hence it is possible to reduce the dimension of the main body 100 including the movable width of the connector unit. In addition, the lever 153 can be smoothly inserted into the groove 16 owing to the above-mentioned structure.

Moreover, it is possible to use space more effectively by making the rib 18 for opening and closing the shutter 130 of the main body 100 be a wall member in an end constituting the above-mentioned groove 16.

Furthermore, as previously stated, since the above-mentioned groove 16 also serves as cartridge attachment guide portion in the direction orthogonal to the attachment direction at the time of attachment of the cartridge 2, it is possible to improve positional accuracy with the opening and closing mechanism of the shutter 130 in the main body 100, and also to contribute to the miniaturization of a laser shutter mounting portion of the main body 100.

(Embodiment 2)

In this embodiment, only items different from those in the above-mentioned first embodiment will be explained, and the explanation of the other structure similar to that of the first embodiment will be omitted.

Next, the structure of the connector arranged in the main body will be explained.

Figure 20:
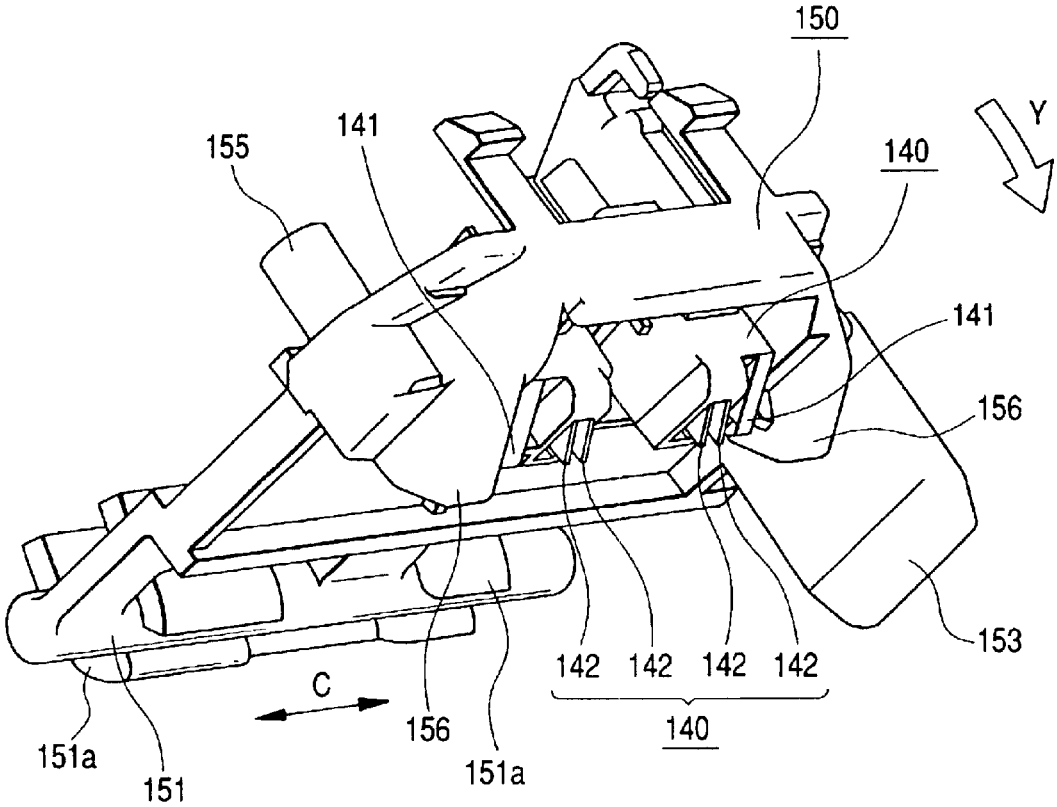
FIG. 20 is a perspective view showing a connector.
Figure 21:
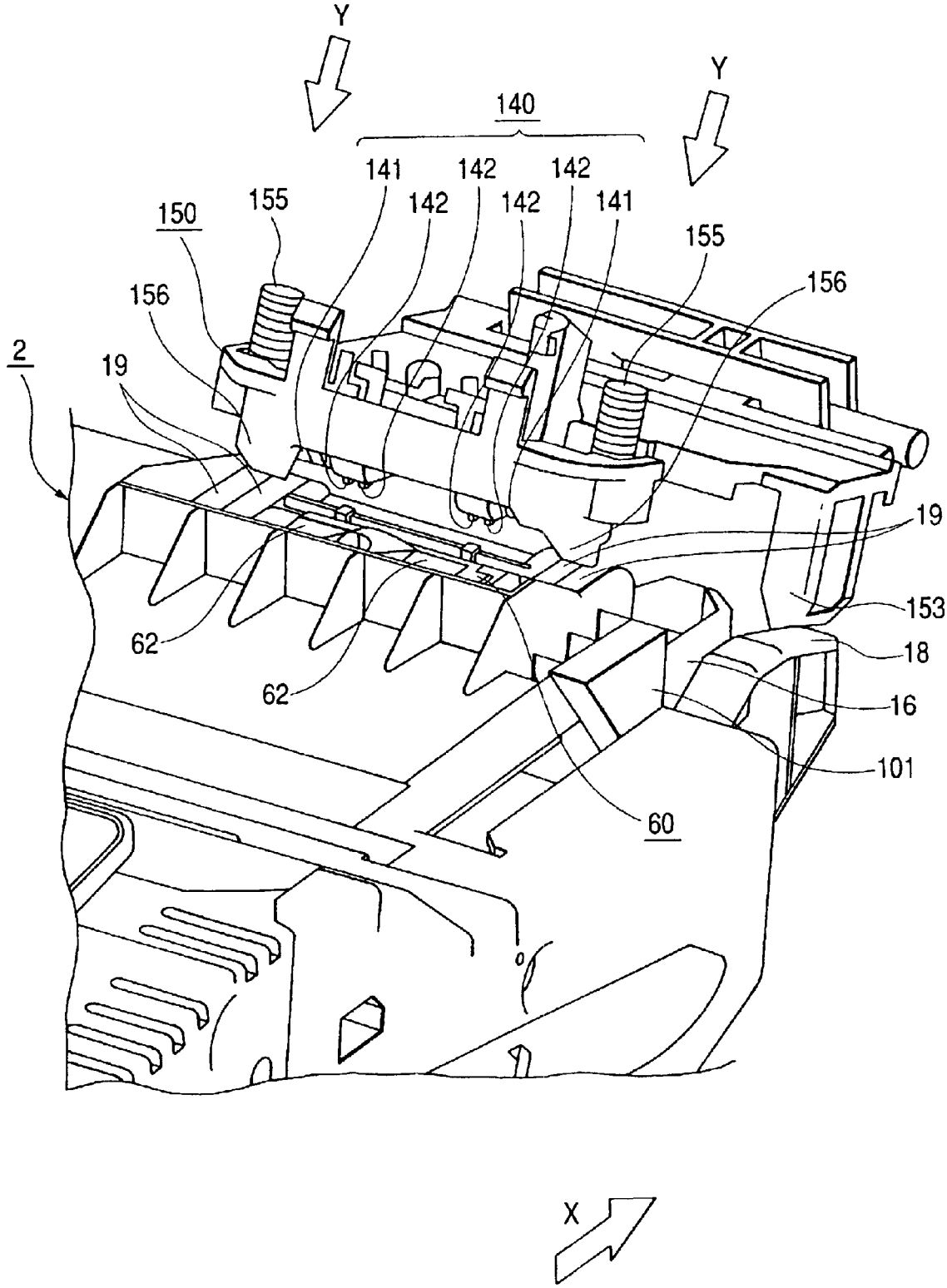
FIG. 21 is an enlarged perspective view showing the allocation of a memory tag and a connector.

As shown in FIGS. 20 and 21, one or two electrical contacts 142 that are metallic main body electrical contacts generating contact pressure by elastic deformation are arranged in the connector 140 per contact portion 62 of the memory tag 60. Beside the electrical contact 142, the bumping portions 141 abutting on the abutting portion 63 (refer to FIGS. 7 and 9) of the memory tag 60 are provided in the vicinity of both sides in the longitudinal direction respectively. In the opposite side of a contact portion of the electrical contact 142 to the memory tag 60, a lead wire is connected to a control unit (not shown) of the main body 100.

The connector holder 150 comprises a rotation axis 151, a connector mounting portion 152, and a longitudinal positioning lever 153 that it is a main body support member positioning-portion.

The connector 140 is fixed to the connector holder 150 with snap fitting or screws, etc. (not shown). In addition, the connector holder 150 rotates on the rotation axis 151 as previously stated, and as shown in FIG. 12, the rotation axis 151 is slidably supported in the longitudinal direction (direction shown by an arrow C (that is, direction orthogonal to the attachment direction of the cartridge 2) by a bearing 151*a* in the main body 100. Then, the connector holder 150 is energized in the direction shown by an arrow Y by a spring 155.

Next, the connection of the connector 140 and memory tag 60 will be explained according to the attachment operation of the cartridge 2 to the main body 100.

Figure 25:
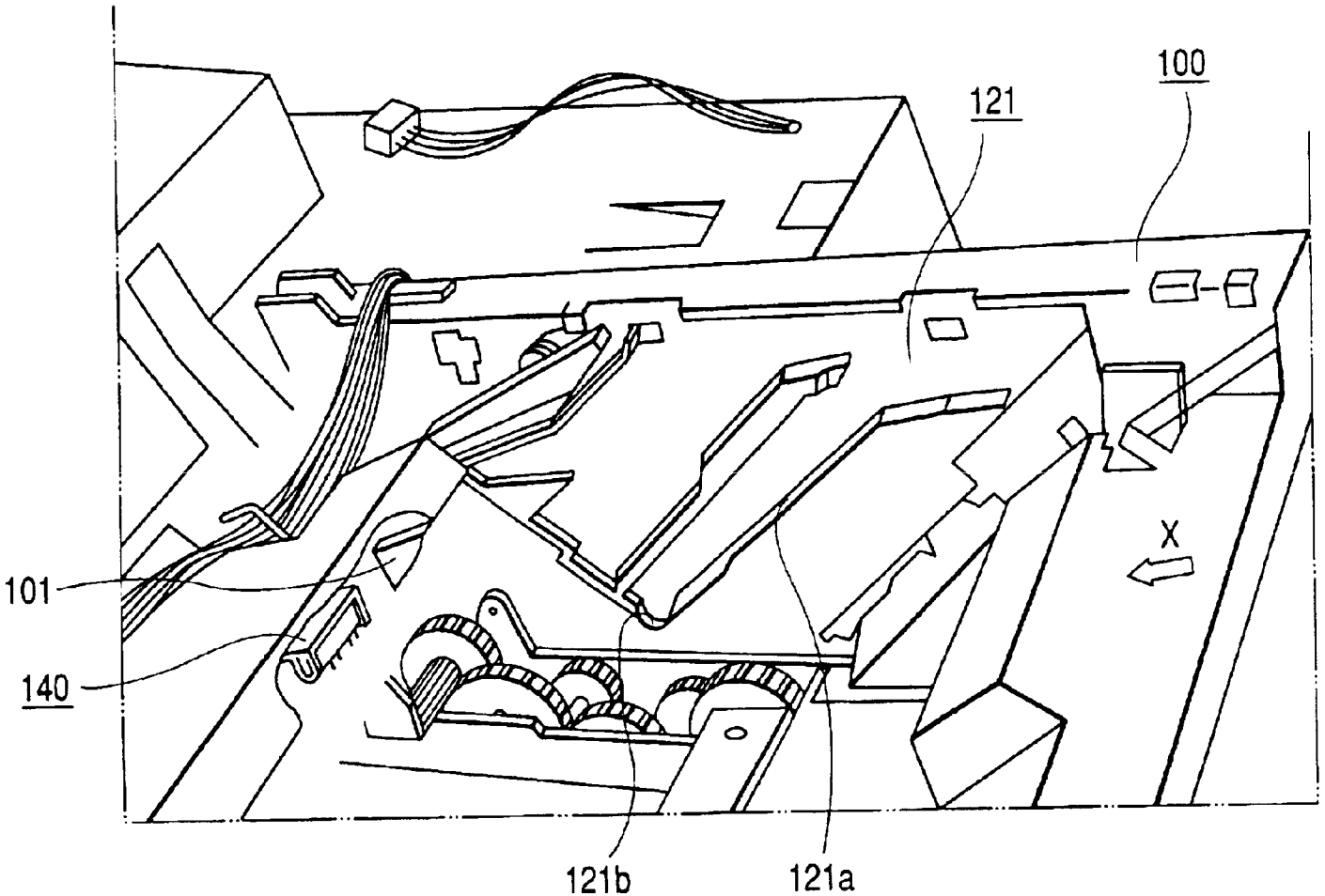
FIG. 25 is a perspective view showing attachment guide means in a right side of a main body of an image forming apparatus.
Figure 26:
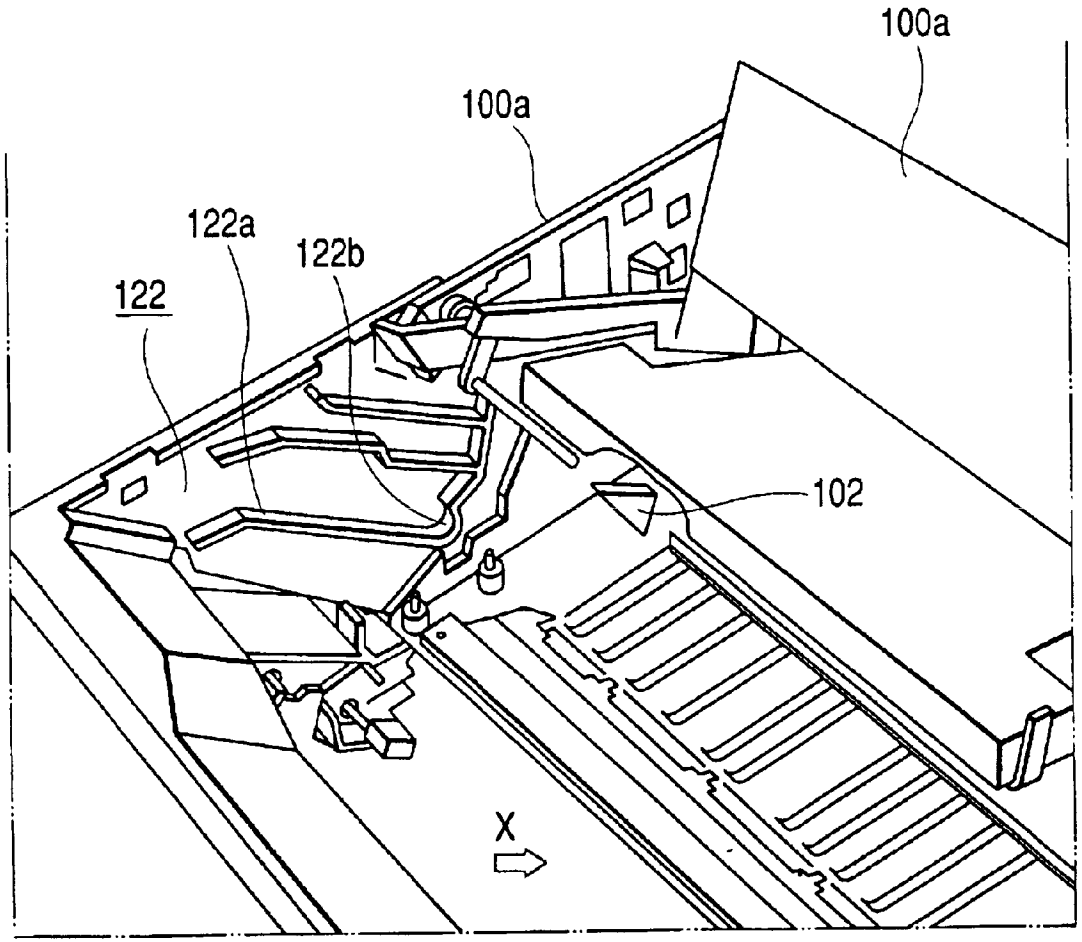
FIG. 26 is a perspective view showing the attachment guide means in a left side of the main body of the image forming apparatus.

In addition, similarly to the first embodiment, the regulating and abutting portion 16*a* (not shown) in the right side of the cartridge 2 is provided in the groove 16 that is an attachment guide portion that has a wall member composed of the rib 18 that opens or closes the shutter 130 that is a laser beam shield member (exposure optical shield member) of the main body 100. In addition, the left regulating and abutting portion 17*a* is provided in the groove 17 that is an attachment guide portion whose outside is opened (not shown). As shown in FIGS. 21, 25, and 26, when the cartridge 2 is inserted into the main body 100 in the direction shown by an arrow X, the cartridge attachment guide portions 16*b* and 16*c* (not shown) of the groove 16 of the cartridge 2 sandwich the fixed member 101 in the main body 100 during insertion (refer to FIGS. 5 and 6), and hence, guide the cartridge 2 in the direction orthogonal to the attachment direction of the cartridge 2. A longitudinal positioning lever 153 that is a main body support member positioning portion of the connector holder 150 that is a main body electrical contact supporting member that is arranged movably in the longitudinal direction (above-mentioned orthogonal direction) enters between end portions 16*b* and 16*c* of the point of the above-mentioned groove 16, when the cartridge 2 is further inserted, and positioning of the connector 140 in the longitudinal direction to the cartridge 2 is performed.

That is, the walls 16*b* and 16*c* of the groove 16 that is the above-mentioned attachment guide portion are cartridge attachment guide portions to guide the cartridge 2 in the direction orthogonal to the attachment direction. In addition, the walls 16*b* and 16*c* are cartridge supporting member positioning portions to perform the positioning of the connector 140 in the longitudinal direction that has the electrical contact 142 for the cartridge 2. Moreover, a bottom portion 16*a* of the groove 16 is a rotation regulating and abutting portion that abuts on the fixed member 101, which is a main body rotation regulating portion, and regulates the rotation of the cartridge 2. Therefore, the miniaturization of the cartridge 2 becomes possible. In addition, since the fixed member 101 that is a main body rotation regulating portion is also a main body cartridge attachment guide portion that performs guidance in the direction orthogonal to the attachment direction of the cartridge 2, the miniaturization of the main body of the apparatus becomes also possible.

Figure 22:
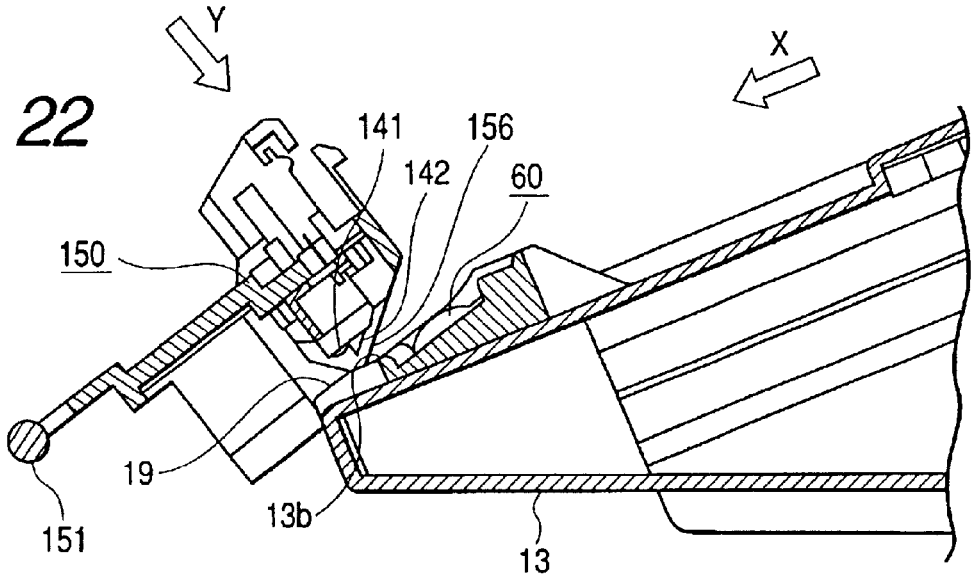
FIG. 22 is a vertical sectional view showing a state where a connector holder guide abuts on a guide rib.
Figure 23:
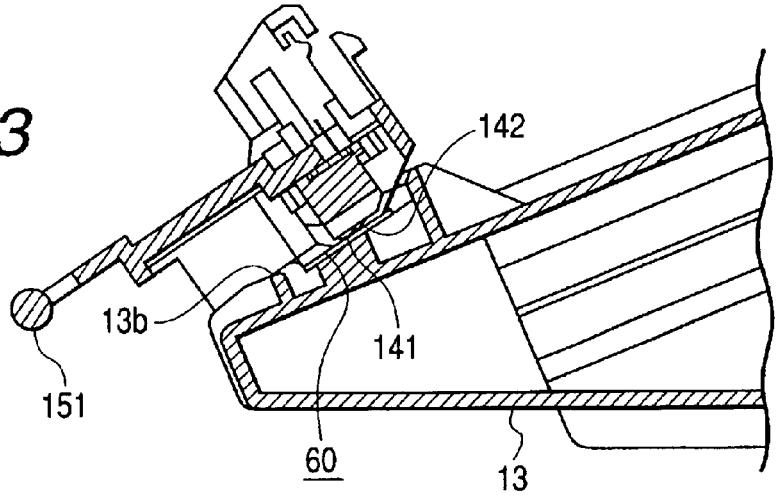
FIG. 23 is a vertical sectional view showing a state where a connector abuts on a memory tag.
Figure 24:
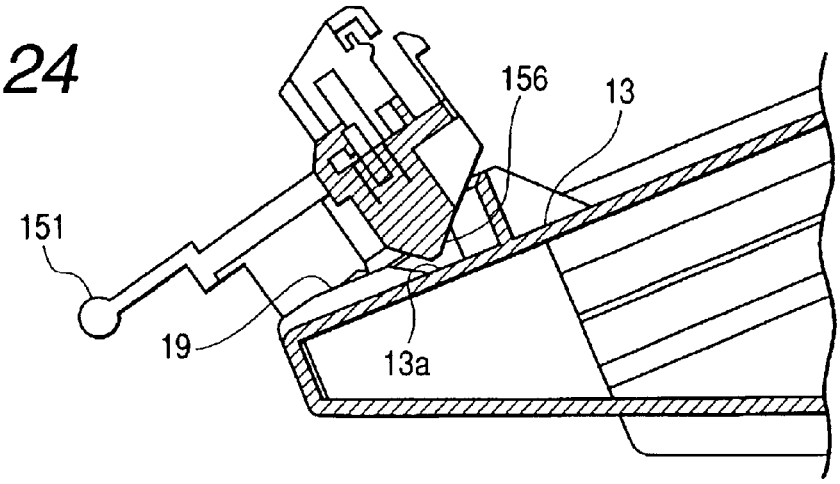
FIG. 24 is a vertical sectional view showing the connector holder guide and guide rib in the state shown in FIG. 23.
Figure 37:
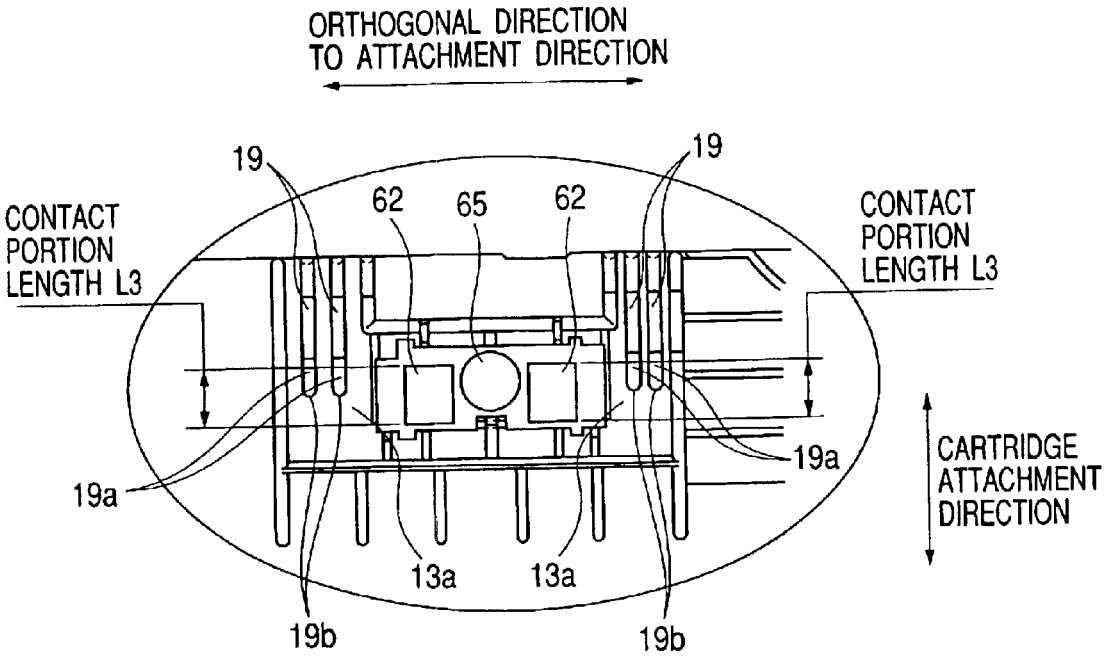
FIG. 37 is a plan showing the positional relation between a connector holder guide and a memory tag of a process cartridge.
Figure 38:
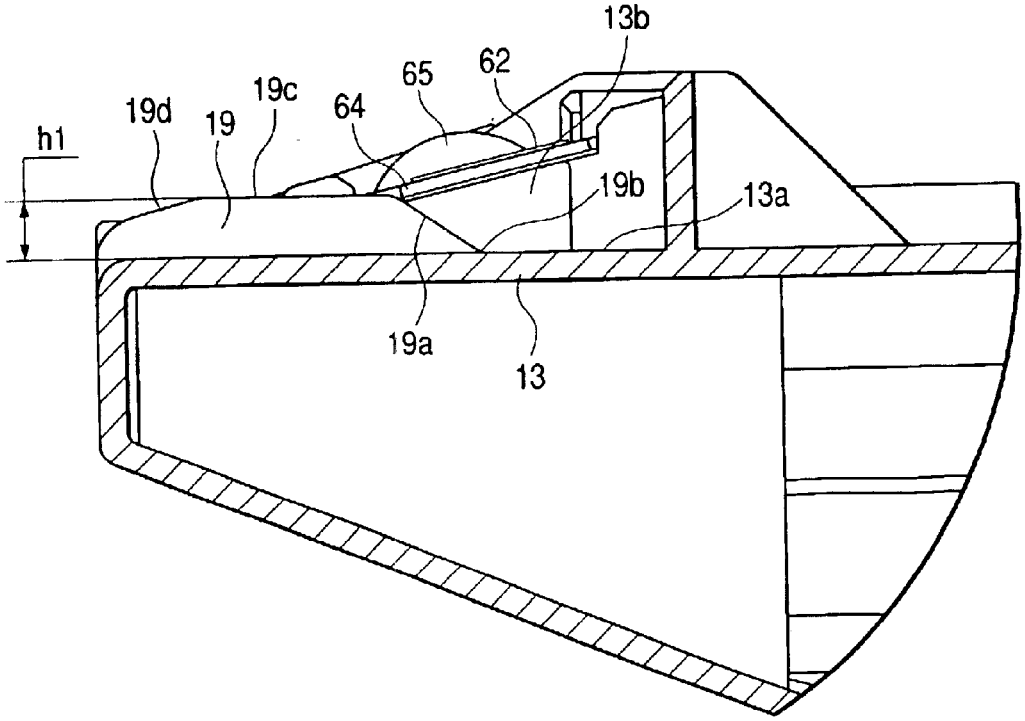
FIG. 38 is a vertical sectional view showing the positional relation between the connector holder guide and the memory tag of the process cartridge.

Moreover, as shown in FIG. 21, in the drum frame body 13 of the cartridge 2, a connector holder guide 19 that is a cartridge abutting portion is provided in the vicinity of both ends of a mounting portion of the memory tag 60. Then, the connector holder 150 is energized in the direction shown by an arrow Y by a spring 155 as previously stated. Then, as shown in FIG. 22, when the cartridge 2 is further inserted, a guide rib 156 that is a main body abutting portion provided in the connector holder 150 abuts on the connector holder guide 19 and slides. At this time, the electrical contact 142 and abutting portion 63 of the connector 140 do not contact the memory tag 60 and the drum frame body 13 that is a frame body supporting the memory tag 60. The connector holder guide 19 is set at height h1 by which the above-mentioned structure can be obtained. In addition, as shown in FIGS. 37 and 38, in the direction orthogonal to the cartridge attachment direction, an inclined plane 19*a* is provided in the upstream side of the connector holder guide 19, which is provided parallel to the memory tag 60, in the cartridge attachment direction. Then, the structure is that an edge 19*b* in the upstream portion of the inclined plane 19*a* in the cartridge attachment direction is located within the length L3 of the contact portion 62 in the cartridge attachment direction as shown in FIG. 37. The guide rib 156 is lowered along the inclined plane 19*a* owing to the above-mentioned structure. Then, the connector holder 150 is guided so that the electrical contact 142 may abut on the contact portion 62 of the memory tag 60 immediately before being attached in a predetermined attachment position of the main body 100. It is possible to come in contact smoothly without the impact being given to the electrical contact 142 when the electrical contact 142 and contact portion 62 come in contact owing to the above-mentioned structure. As shown in FIGS. 23 and 24, the bumping portion 141 abuts on the abutting portion 63 of the memory tag 60, and the guide rib 156 comes to a position that corresponds to the concave portion 13*a* that is a surface of the frame body to be apart from the frame body 13 (FIG. 24 is a sectional view showing the positional relation between the connector holder guide 19 and guide rib 156 in the state in which the connector 140 is abutting on the memory tag 40(FIG. 23)). In addition, the memory tag 60 is provided in the mounting portion 13*b* that projects from an upper side of the cartridge frame body 13. Then, when the process cartridge is attached in the above-mentioned apparatus position, the height of the above-mentioned mounting portion 13*b* is set at such a height that a space is formed between the guide rib 156 and a surface 13*a* of the cartridge frame body as shown in FIG. 24.

Then, the cylindrical portion 14*a* of the drum bearing 14, which is a positioning member of the cartridge 2, and the cylindrical portion 15*a* of the drum shaft 15 reach the positioning grooves 121*b* and 122*b* of the main body 100 (refer to FIGS. 25 and 26).

In the cartridge 2, as for the relation between primary moments of sides of the cleaning unit 10 and developing unit 20 around a central line that connects the center of the cylindrical portion 14*a* of the drum bearing 14 to the cylindrical portion 15*a* of the drum shaft 15, weight is distributed so that the side of the developing unit 20 may have a larger primary moment than the side of the cleaning unit 10. Hence, the cartridge 2 rotates clockwise on a line connecting the cylindrical portion 14*a* of the drum bearing 14 and the cylindrical portion 15*a* of the drum shaft 15, the regulating and abutting portions 16*a* and 17*a* of the cartridge 2 abut on points of the fixed members 101 and 102, and the insertion operation of the cartridge 2 is completed.

Owing to the above-mentioned structure, since the electrical contact 142 of the connector 140 of the main body 100 comes in contact surely and stably with contact portion by preventing the electrical contact 142 from coming in to abut on a portion excluding the memory tag 60 (for example, the rib 13*b*, etc., provided in an end of the memory tag 60 in the cartridge 2 insertion direction) because of the dispersion of the posture of the cartridge 2 during attachment to the main body 100, reliable continuity of electrical connection can be secured.

Then, since the deflection of the electrical contact 142 becomes constant and it is possible to make contact pressure to the contact portion 62 of the memory tag 60 to be a desired contact pressure, it is possible to stabilize the continuity of electrical connection.

In addition, similarly to the first embodiment, as previously stated, by arranging the groove 16 near the memory tag 60 of the cartridge 2 and positioning the connector holder 150, where the connector 140 of the main body 100 is installed, by the walls 16*b* and 16*c* that are cartridge supporting member positioning portions of the groove 16, it is possible to make the contact portion 62 of the memory tag 60 and the connector 140 accurately abut and to maintain this state. Owing to this, it is possible to prevent the contact shift of the memory tag 60, and to plan the miniaturization of the connector unit.

Moreover, the above-mentioned groove 16 can reduce the movable width of the connector unit in the longitudinal direction since the groove 16 also serves as the cartridge attachment guide portion in the direction orthogonal to the attachment direction when the cartridge 2 is attached to the main body 100, and hence it is possible to reduce the dimension of the main body 100 including the movable width of the connector unit. In addition, the lever 153 can be smoothly inserted into the groove 16 owing to the above-mentioned structure.

In addition, it is possible to use space more effectively by making the rib 18 for opening and closing the shutter 130 of the main body 100 be a side wall in an end constituting the above-mentioned groove 16. Moreover, as previously stated, since the above-mentioned groove 16 also serves as cartridge attachment guide portion in the direction orthogonal to the attachment direction at the time of attachment of the cartridge 2, it is possible to improve positional accuracy with the opening and closing mechanism of the shutter 130 in the main body 100, and also to contribute the miniaturization of a laser shutter mounting portion of the main body 100.

(Embodiment 3)

In this embodiment, only items different from those in the above-mentioned first and second embodiments will be explained, and the explanation of the other structure similar to that of the first embodiment will be omitted.

Next, the structure of a connector arranged in the main body 100 will be explained.

Figure 27:
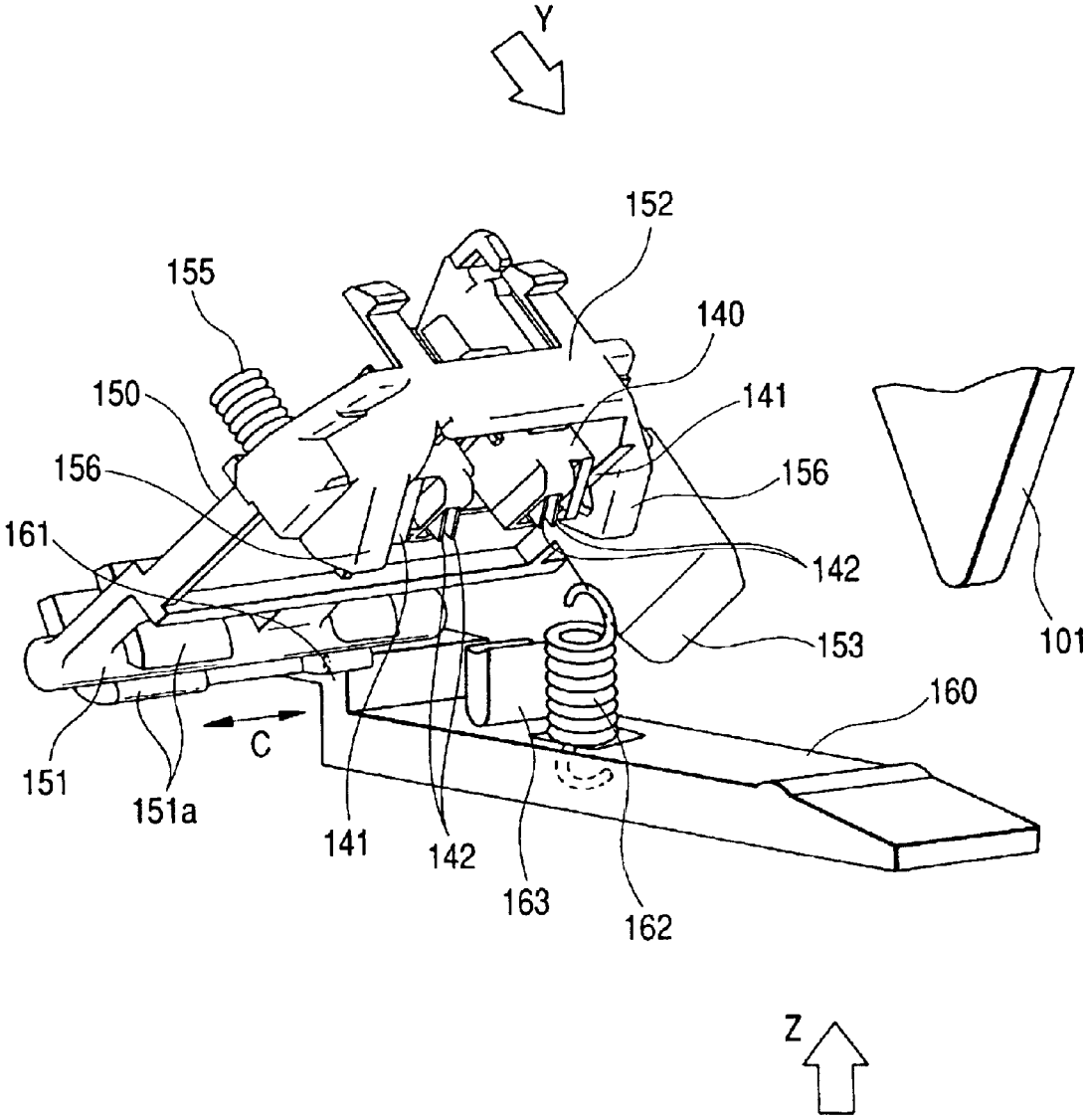
FIG. 27 is a perspective view showing a connector.

As shown in FIG. 27, one or two electrical contacts 142 that are metallic main body electrical contacts generating contact pressure by elastic deformation are arranged in the connector 140 per contact portion 62 of the memory tag 60. In sides of the electrical contact 142, the bumping portions 141 abutting on the abutting portion 63 (refer to FIGS. 7 and 9) of the memory tag 60 are provided in the vicinity of both sides in the longitudinal direction respectively. In the opposite side of a contact portion of the electrical contact 142 to the memory tag 60, a lead wire is connected to a control unit (not shown) of the main body 100.

The connector holder 150 comprises a rotation axis 151, a connector mounting portion 152, and a longitudinal positioning lever 153 that it is a main body support member positioning portion.

The connector 140 is fixed to the connector holder 150 with snap fitting or screws, etc. (not shown). In addition, as shown in FIG. 27, the connector holder 150 rotates around the rotation axis 151 as previously stated, and as shown in FIG. 12, the rotation axis 151 is slidably supported in the longitudinal direction (direction shown by an arrow C, that is, a direction orthogonal to the attachment direction of the cartridge 2) by a bearing 151*a* in the main body 100. Then, the connector holder 150 is energized in the direction shown by an arrow Y by a spring 155.

Next, the connection of the connector 140 and memory tag 60 will be explained according to the attachment operation of the cartridge 2 to the main body 100.

Figure 28:
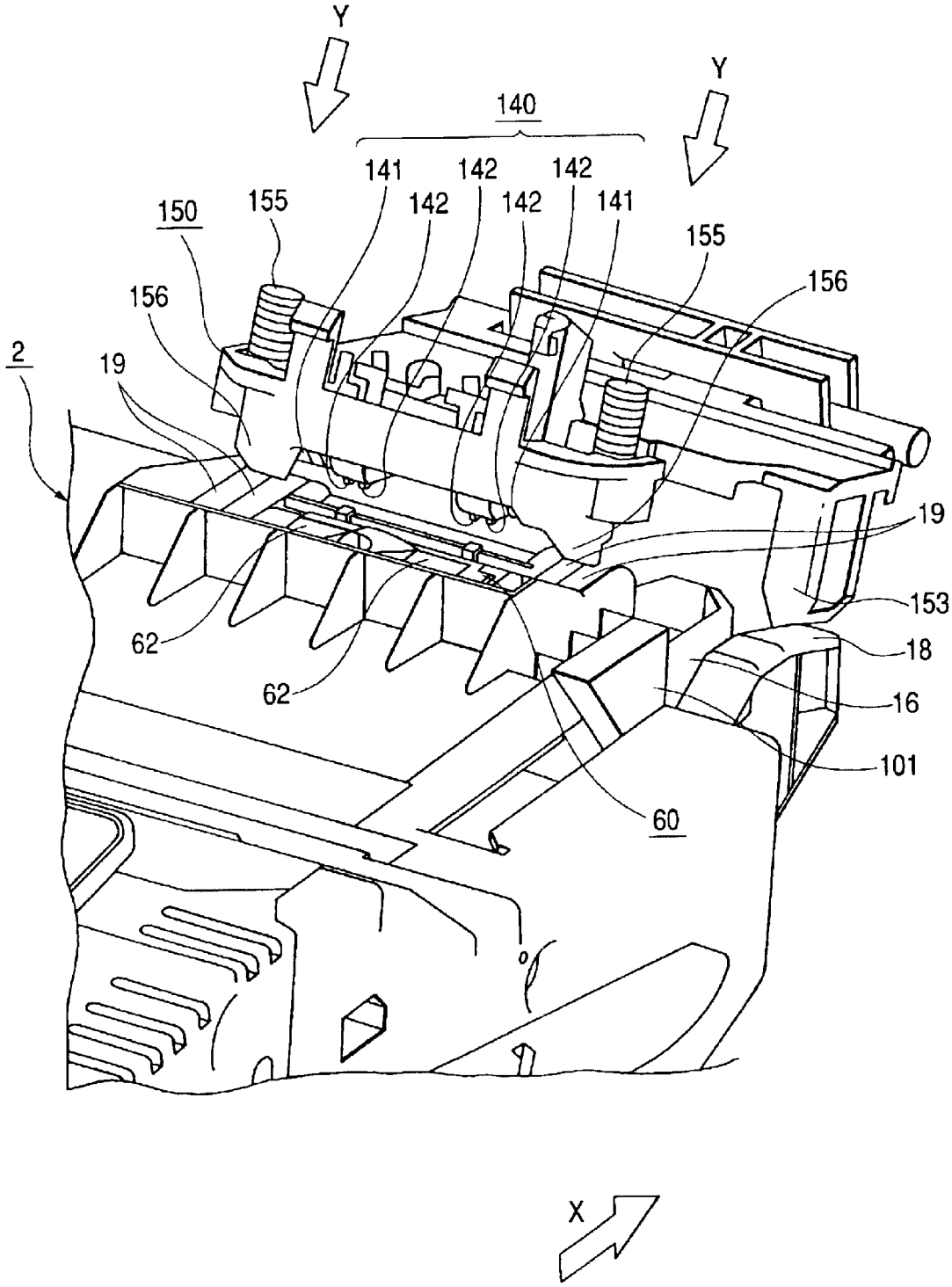
FIG. 28 is an enlarged perspective view showing the allocation of a memory tag and a connector.
Figure 32:
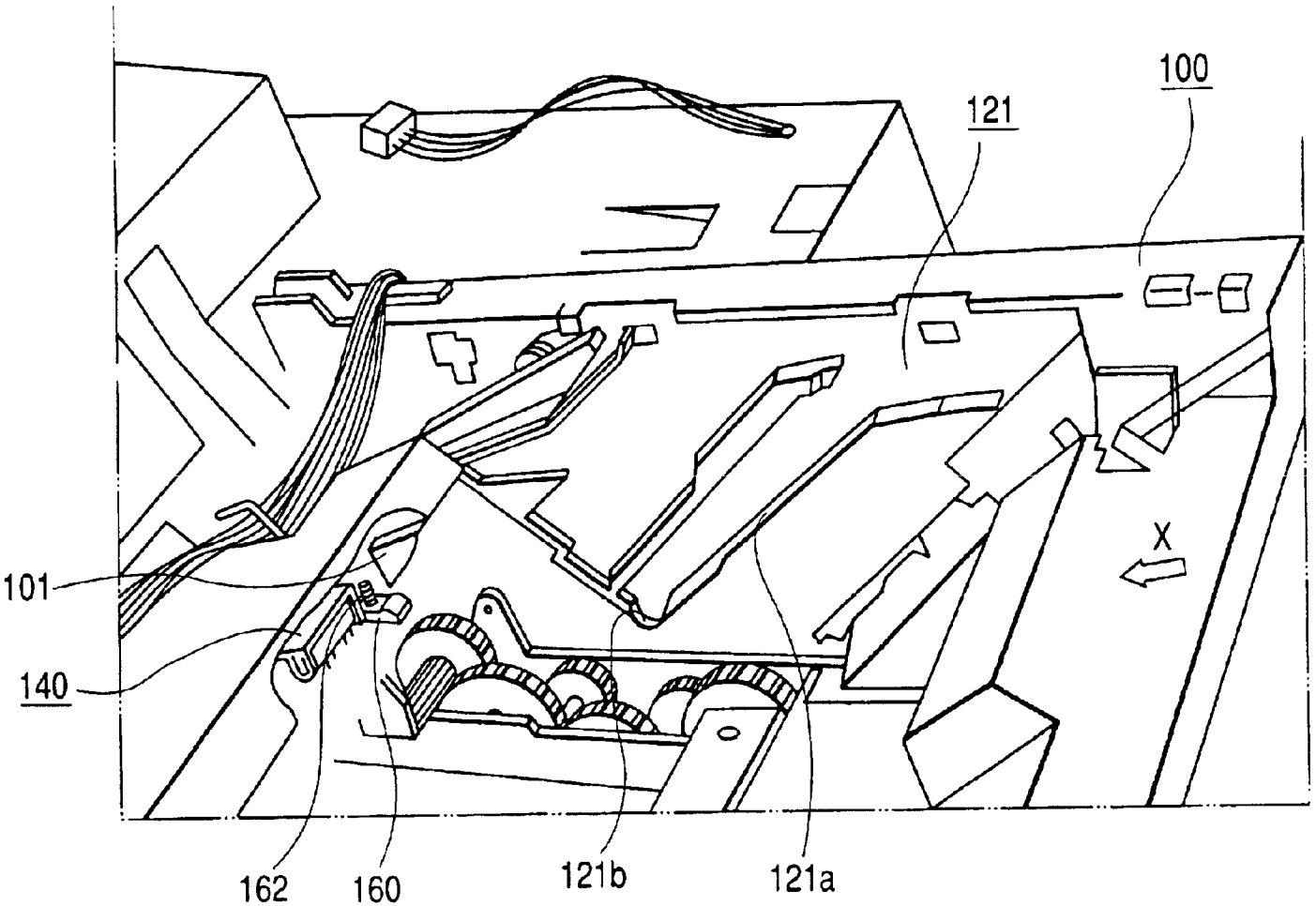
FIG. 32 is a perspective view showing attachment guide means in the right side of a main body of an image forming apparatus.
Figure 33:
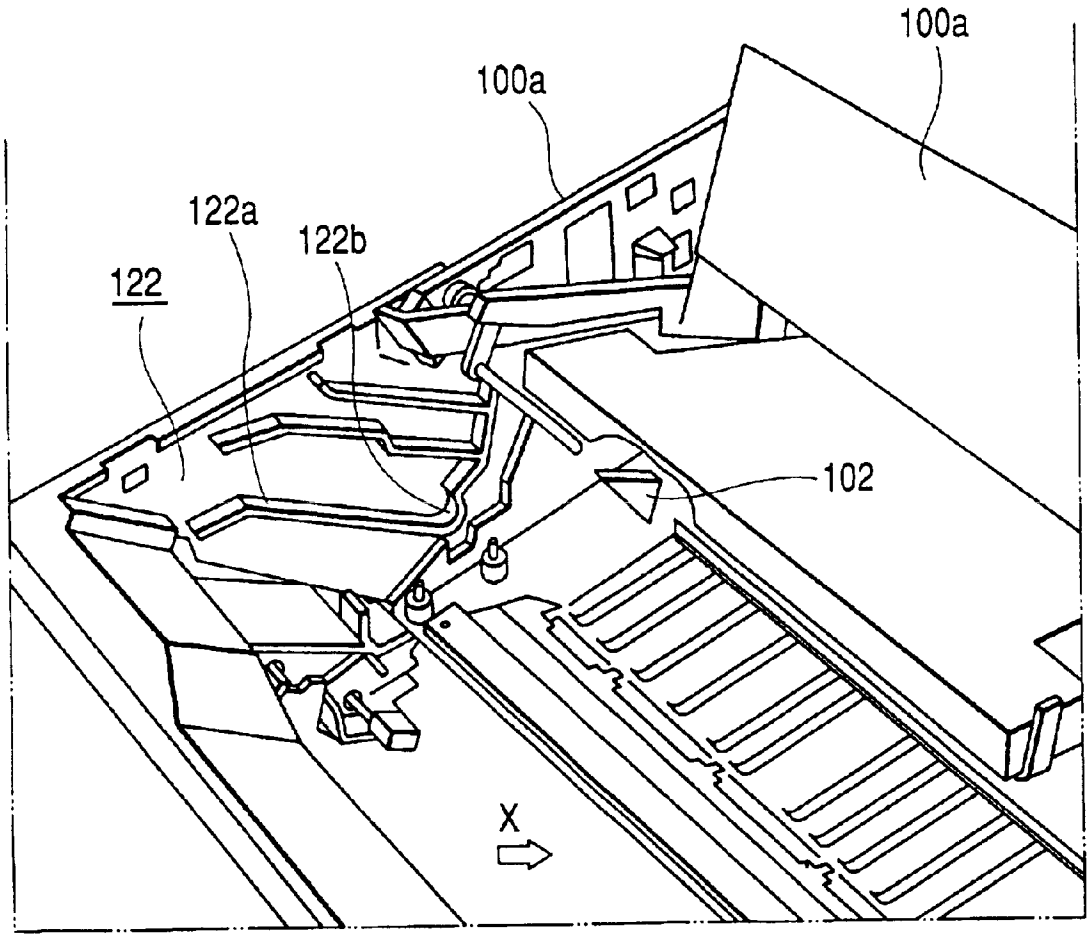
FIG. 33 is a perspective view showing attachment guide means in the left side of a main body of an image forming apparatus.

In addition, similarly to the first and second embodiments, the regulating and abutting portion 16*a* (not shown) in the right side of the cartridge 2 is provided in the groove 16 that is an attachment guide portion that has a wall member composed of the rib 18 that opens or closes the shutter 130 that is a laser beam shield member (exposure optical shield member) of the main body 100 (not shown). In addition, the left regulating and abutting portion 17*a* is provided in the groove 17 that is an attachment guide portion whose outside is opened (not shown). As shown in FIGS. 28, 32, and 33, when the cartridge 2 is inserted into the main body 100 in the direction shown by an arrow X, the cartridge attachment guide portions 16*b* and 16*c* of the groove 16 of the cartridge 2 sandwich the fixed member 101 in the main body 100 on the way of insertion (refer to FIGS. 5 and 6), and hence, guide the cartridge 2 in the direction orthogonal to the attachment direction of cartridge 2. A longitudinal positioning lever 153 that is a main body support member positioning portion of the connector holder 150 that is a main body electrical contact supporting member that is arranged movably in the longitudinal direction (above-mentioned orthogonal direction) enters between end portions 16*b* and 16*c* of the point of the above-mentioned groove 16, when the cartridge 2 is further inserted, and positioning of the connector 140 in the longitudinal direction to the cartridge 2 is performed.

That is, the walls 16*b* and 16*c* of the groove 16 that is the above-mentioned attachment guide portion are cartridge attachment guide portions to guide the cartridge 2 in the direction orthogonal to the attachment direction. In addition, the walls 16*b* and 16*c* are cartridge supporting member positioning portions to perform the positioning of the connector 140 in the longitudinal direction that has the electrical contact 142 for the cartridge 2. Moreover, a bottom portion 16*a* of the groove 16 is a rotation regulating and abutting portion that abuts on the fixed member 101, which is a main body rotation regulating portion, and regulates the rotation of the cartridge 2. Therefore, the miniaturization of the cartridge 2 becomes possible. In addition, since the fixed member 101 that is a main body rotation regulating portion is also a main body cartridge attachment guide portion that performs guidance in the direction orthogonal to the attachment direction of the cartridge 2, the miniaturization of the main body of the apparatus becomes also possible.

Figure 29:
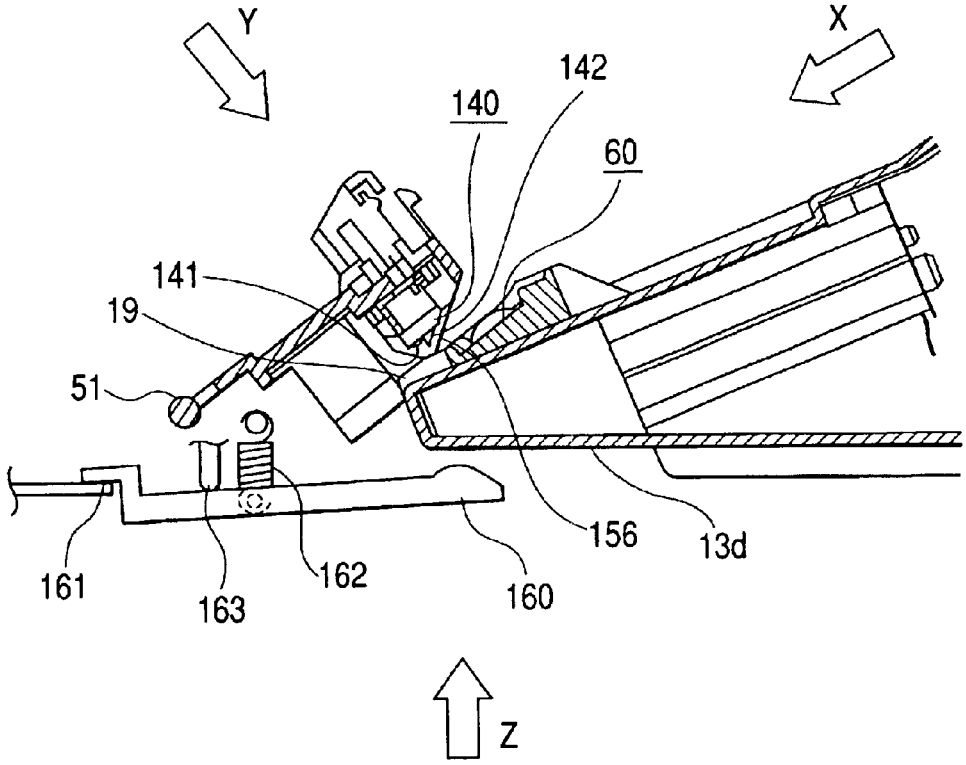
FIG. 29 is a vertical sectional view showing a state where a connector holder guide abuts on a guide rib.
Figure 30:
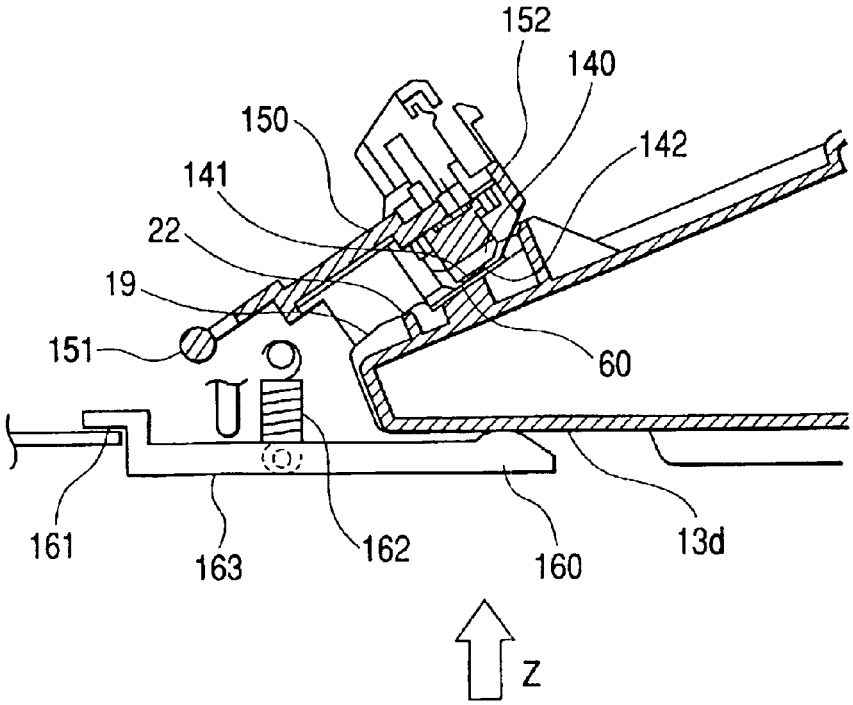
FIG. 30 is a vertical sectional view showing a state where a connector abuts on a memory tag.
Figure 31:
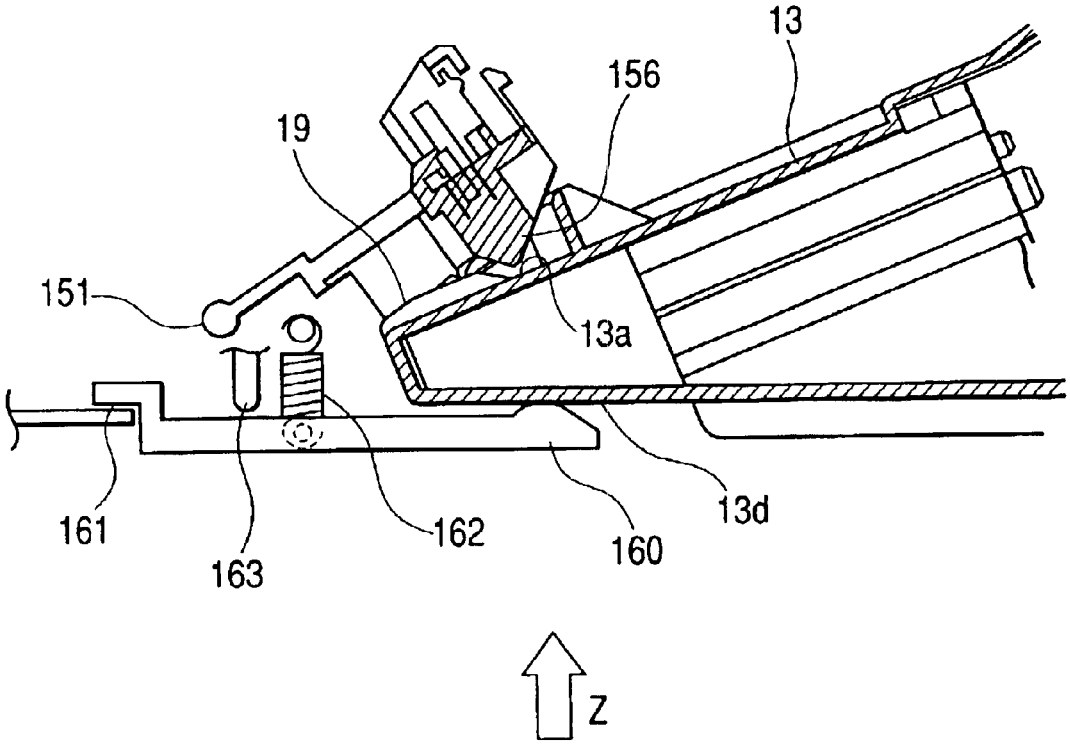
FIG. 31 is a vertical sectional view showing the connector holder guide and guide rib in the state shown in FIG. 23.

Moreover, as shown in FIG. 28, in the cartridge 2, a plurality of rib-like connector holder guides 19 that are parallel to the inserted direction of the cartridge 2 into the main body 100 is provided in the vicinity of both ends of a mounting portion of the memory tag 60. Then, the connector holder 150 is energized in the direction shown by an arrow Y by a spring 155 as previously stated. Then, as shown in FIG. 29, when the cartridge 2 is further inserted, a guide rib 156 that is a main body abutting portion provided in the connector holder 150 abuts on a portion 19*c* of the connector holder guide 19 and slides thereafter (According to circumstances, after abutting on the portion 19*d* of the connector holder guide 19 first, the guide rib 15 slides to the portion 19*c*). At this time, the electrical contact 142 and abutting portion 63 of the connector 140 (refer to FIG. 7) do not abut on the memory tag 60 and the drum frame body 13 supporting the memory tag 60. The connector holder guide 19 is set at height h1 by which the above-mentioned structure can be obtained. In addition, as shown in FIGS. 37 and 38, in the direction orthogonal to the cartridge attachment direction, an inclined plane 19*a* is provided in the upstream side of the connector holder guide 19 toward the direction of the cartridge attachment, which is provided in parallel to the memory tag 60, in the cartridge attachment direction. Then, the structure is that an edge 19*b* upstream of the inclined plane 19*a* in the cartridge attachment direction is located within the length L3 of the contact portion 62 in the cartridge attachment direction as shown in FIG. 37. The guide rib 156 is lowered along the inclined plane 19*a* owing to the above-mentioned structure. Then, the connector holder 150 is guided so that the electrical contact 142 may abut on the contact portion 62 of the memory tag 60 immediately before being attached in a predetermined attachment position of the main body 100. It is possible to come in contact smoothly without impact being given to the electrical contact 142 when the electrical contact 142 and contact portion 62 come in contact owing to the above-mentioned structure. Then, as shown in FIGS. 30 and 31, when the bumping portion 141 abuts on the abutting portion 63 (refer to FIG. 7) of the memory tag 60, the guide rib 156 comes to the position that corresponds to the surface 13*a* of the frame body to be apart from the frame body 13. (FIG. 31 is a sectional view showing the positional relation between the connector holder guide 19 and guide rib 156 in such a state (FIG. 30) that the connector 140 abuts on the memory tag 40.) In addition, the memory tag 60 is provided in the mounting portion 13*b* that projects from an upper side of the cartridge frame body 13. Then, when the process cartridge is attached in the above-mentioned apparatus position, the height of the above-mentioned mounting portion 13*b* is set at such height that a space is formed between the guide rib 156 and concave portion 13*a* as also shown in FIG. 24.

In addition, in the main body 100, a pushing member 160 is arranged at the position corresponding to a lower portion of the front of the cartridge 2 in the attachment direction as shown in FIGS. 27, 29, 30, and 31.

This pushing member 160 is rotatably supported by a frame member (not shown) of the main body 100 at a fulcrum 161, and is energized by a tension spring 162 in the direction shown by an arrow Z. In addition, the pushing member 160 keeps a position in which it abuts on a stopper 163 until abutting on the pushed portion 13*d* provided on a lower surface of the frame body 13 of the cartridge. The pushed portion 13*d* is arranged at a position where the pushing member can abut under the condition that the cartridge 2 is inserted into the main body 100.

Figure 34:
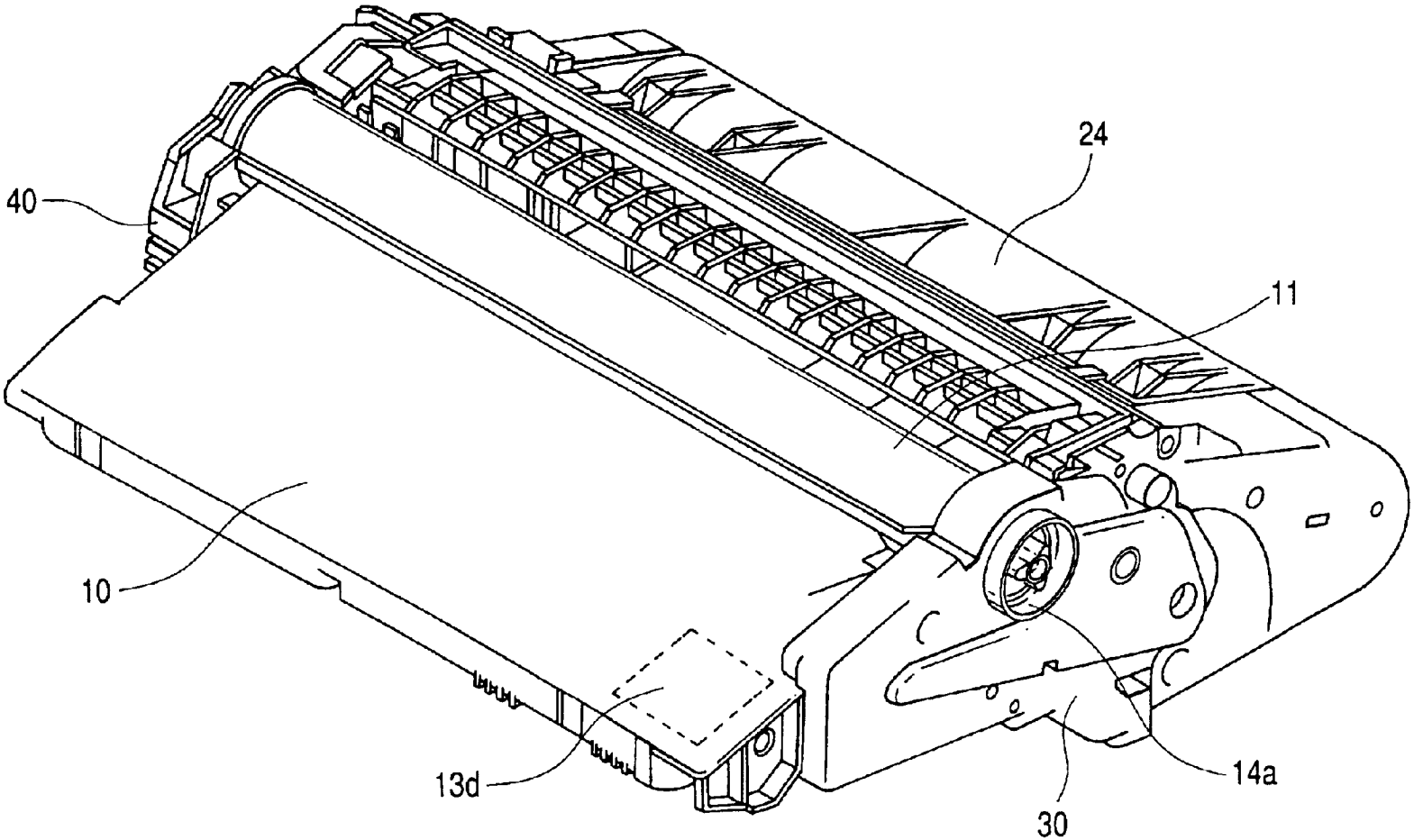
FIG. 34 is a perspective view in view of a process cartridge from its bottom face.

Furthermore, the longitudinal arrangement of the pushed portion 13*d* of the cartridge of this embodiment is between the memory tag 60 and the regulating and abutting portion 16*a* of the cartridge as shown in FIG. 34.

Owing to this pushing member 160, the pushing member 160 abuts on the pushed portion 13*d* of the cartridge 2 almost at the same time as the operation of attaching the above-mentioned cartridge 2 in a predetermined position of the main body 100.

Then, the cylindrical portion 14*a* (refer to FIG. 6) of the drum bearing 14 of the cartridge 2 and the cylindrical portion 15*a* (refer to FIG. 5) of the drum shaft 15 reach the positioning grooves 121*b* and 122*b* of the main body 100 (refer to FIGS. 32 and 33).

In addition, as for the relation between primary moments of sides of the cleaning unit 10 and developing unit 20 around a central line (hereafter, this is called a drum axial line) that connects the center of the cylindrical portion 14*a* of the drum bearing 14 to the cylindrical portion 15*a* of the drum shaft 15, weight is distributed so that the side of the developing unit 20 may have larger moment rotating downward than the side of the cleaning unit 10.

In addition, a moment generated by a force of the connector in the direction shown by an arrow Y is generated around the drum shaft line in the memory tag 60. However, a moment in the direction opposite to the moment generated by the above-mentioned connector 140 is generated since the pushed portion 13*d* of the cartridge 2 is pushed in the direction shown by an arrow Z by the pushing member 160.

In addition, in order that the regulating and abutting portions 16*a* and 17*a* of the below-mentioned cartridges 2 may surely abut on points of the fixed members 101 and 102, the desirable relation between the moments around the drum shaft line of the cartridge 2 is as follows:

Moment of connector 140≦Moment of pushing member 160

Figure 35:
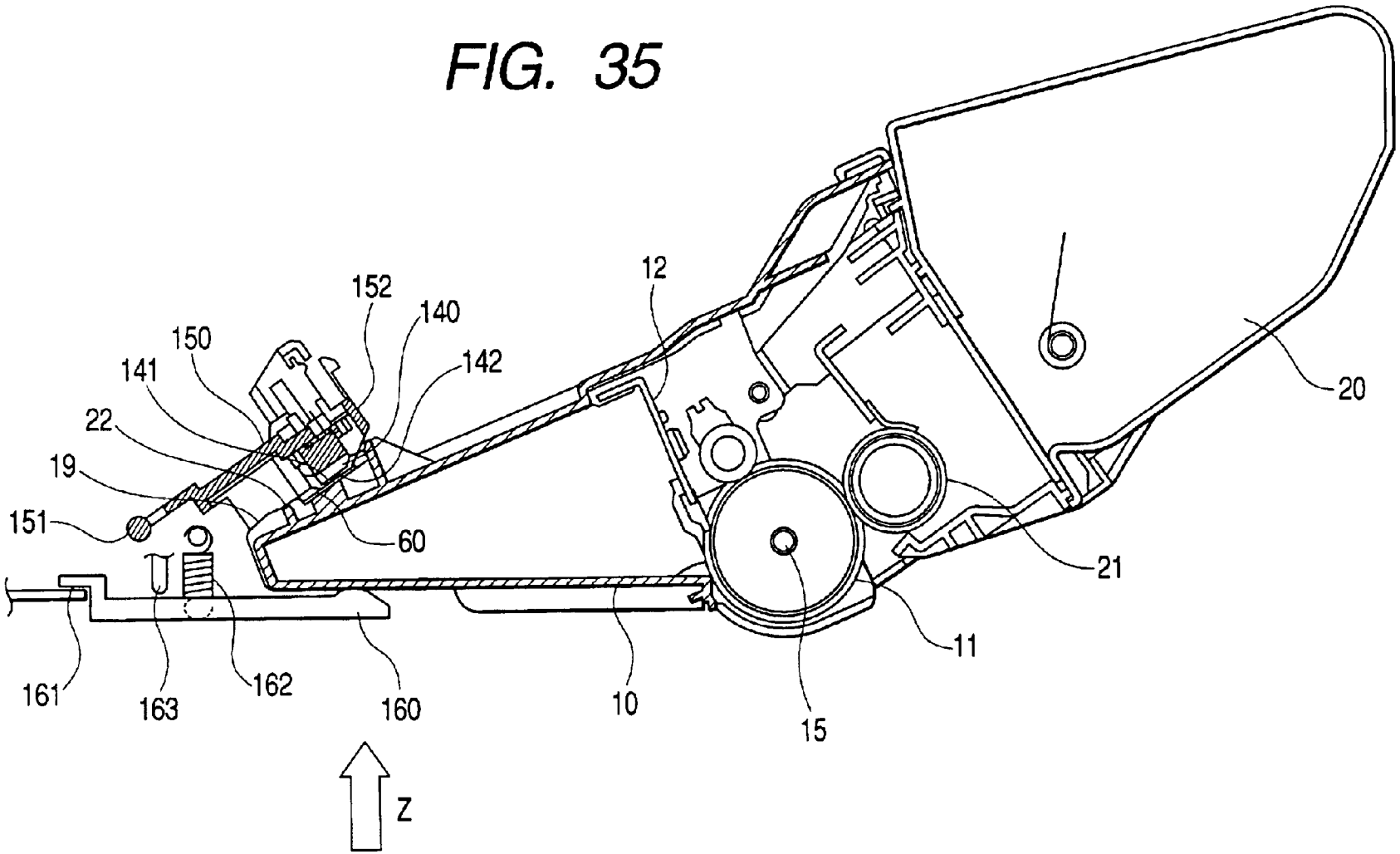
FIG. 35 is a sectional view showing a process cartridge.
Figure 36:
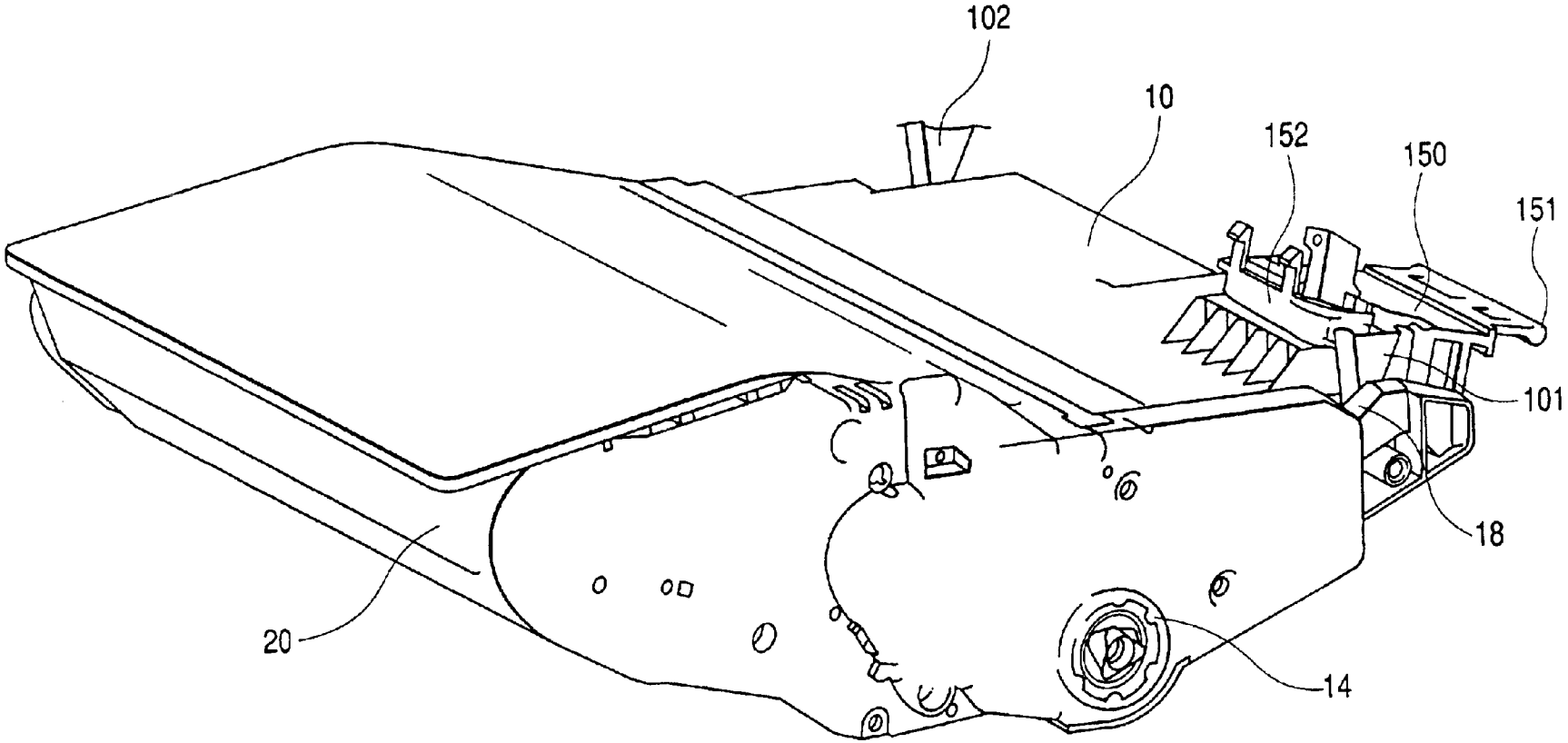
FIG. 36 is a perspective view in a state where a process cartridge is attached to an image forming apparatus in place.

Furthermore, as shown in FIG. 35, the cartridge 2 rotates clockwise on the drum axial line (in FIG. 35, around the photosensitive drum 11), the regulating and abutting portions 16*a* and 17*a* of the cartridge 2 abut on points of the fixed members 101 and 102 shown in FIG. 36, and the insertion operation of the cartridge 2 is completed.

In addition, since the photosensitive drum 11 rotates clockwise when the photosensitive drum 11 is given a rotation drive force from driving means (not shown) of the main body 100, the cartridge 2 also rotates clockwise. Therefore, also when being given the rotation drive force from the main body 100, the regulating and abutting portions 16*a* and 17*a* (not shown) of the cartridge 2 always abut on the points of the fixed members 101 and 102 of the main body 100.

In addition, although the pushed portion 13*d* of the cartridge is arranged in a lower side (paper-passing side) in the above-mentioned structure, the section arrangement of the pushed portion 13*d* of the cartridge and the main body pushing portion 160 may have such relation that the moment to resist a force in the direction shown by an arrow Y with respect to the drum shaft line of the cartridge 2 is obtained.

Furthermore, also in the longitudinal arrangement, a desirable position is the same position as the connector 140, but so long as it is in its neighborhood, a similar effect can be obtained.

Since the regulating and abutting portions 16*a* and 17*a* of the cartridge 2 surely abut on the points of the fixed members 101 and 102 owing to the above-mentioned structure, positioning of cartridge 2 with the main body can be accurately performed.

In addition, since the deflection of the electrical contact 142 becomes constant because the positioning of the cartridge 2 and connector 140 is accurately performed, it is possible to make the contact pressure to the contact portion 62 of the memory tag 60 be a desired contact pressure, and hence, it is possible to stabilize the continuity of the electrical connection.

Furthermore, as mentioned above, in the cartridge 2, as for the relation between primary moments of sides of the cleaning unit 10 and developing unit 20 around the drum axial line, weight is distributed so that the side of the developing unit 20 may have a larger primary moment than the side of the cleaning unit 10. However, when a large amount of toner in the developing unit 20 of the cartridge is consumed and the waste toner is built up in the cleaning unit 10, the moment where the side of the developing unit 20 rotates downward (clockwise direction) becomes small, and the moment where the side of the cleaning unit 10 rotated downward (counterclockwise direction) becomes large.

Furthermore, also when the cartridge 2 is not given the rotation drive force from the main body 100, even a force in the direction where the regulating and abutting portions 16*a* and 17*a* (not shown) of the cartridge 2 abut on the points of the fixed members 101 and 102 of the main body 100 does not act.

Therefore, the positioning in the clockwise rotation direction along the cylindrical portions 14*a* and 15*a* of the cartridge 2 can be performed with the regulating and abutting portions 16*a* and 17*a* of the cartridge 2 abutting on the points of the fixed member 101 and 102 of the main body 100 by pushing the pushed portion 13*d* of the cartridge 2 with the pushing member 160. Hence, when a large amount of toner in the developing unit 20 of the cartridge 2 is consumed or the cartridge 2 is not given a drive transmission (rotation drive) from the main body 100, the regulating and abutting portions 16*a* and 17*a*, owing to the moment in the direction shown by an arrow Y by the connector 140, can prevent the separation of points of the fixed members 101 and 102 or the occurrence of a contact pressure shortage of the connector 140 to the contact portion 62 of the memory tag 60.

That is, it is possible to increase the reliability of electrical connection of the electrical contact 42 and contact portion 62 regardless of the consumption of toner in the cartridge 2, and further, even when the cartridge 2 is not given the drive transmission from the main body 100.

This is effective for a mass produced cartridge where the variation of weight of the toner in the cartridge 2 is large, or for acceleration of the communication between the memory tag 60 and a control unit (not shown) of the main body 100.

Hence, as explained above, the present invention exhibits such effects that are described as follows.

Electrical connection of a cartridge electrical contact of a process cartridge and a main body electrical contact provided in a main body of an electrophotographic image forming apparatus can be achieved in simple structure.

In addition, it is possible to surely and stably contact the main body electrical contact provided in an electrophotographic image forming apparatus to the cartridge electrical contact portion when the process cartridge is attached to the main body of the electrophotographic image forming apparatus.

Furthermore, a main body electrical contact, provided in a main body of an electrophotographic image forming apparatus, can abut on a cartridge electrical contact without contacting a frame body of the process cartridge, and a main board except the cartridge electrical contact when the process cartridge is attached to the above-described main body of the electrophotographic image forming apparatus.

Moreover, it becomes possible to realize the miniaturization and space-saving of the process cartridge and the main body of the electrophotographic image forming apparatus.

In addition, it is possible to surely and stably contact the main body electrical contact provided in an electrophotographic image forming apparatus to the cartridge electrical contact portion of a main board when the process cartridge is attached to the main body of the electrophotographic image forming apparatus.

Furthermore, it is possible to increase the positional accuracy of contact of the main body electrical contact provided in an electrophotographic image forming apparatus to the cartridge electrical contact portion, provided in the process cartridge, when the process cartridge is attached to the main body of the electrophotographic image forming apparatus.

Moreover, a main body electrical contact, provided in a main body of an electrophotographic image forming apparatus, can smoothly abut on a cartridge electrical contact portion without a shock when the process cartridge is attached to the main body of the electrophotographic image forming apparatus.

What is claimed is:

1. A process cartridge detachable from a main body of an electrophotographic image forming apparatus including a main body electrical contact and main body pushing means, comprising:

an electrophotographic photosensitive drum;

process means for acting on said electrophotographic photosensitive drum;

a frame body;

a memory element configured to store information;

a cartridge electrical contact portion that is electrically connected to said memory element, and is electrically connected to the main body electrical contact when said process cartridge is attached to the main body of the electrophotographic image forming apparatus; and a pushed portion provided at a portion of said frame body, wherein said pushed portion is pushed by the main body pushing means in the direction in which said cartridge electrical contact portion moves so as to be electrically connected to the main body electrical contact when said process cartridge is attached to the main body of the electrophotographic image forming apparatus.

2. A process cartridge according to claim 1, further comprising a main board provided at a portion of said frame body and having said memory element and said cartridge electrical contact, wherein said main board is provided in a top face side of said frame body, and said pushed portion is provided in a bottom face side of said frame body when said process cartridge is attached to the main body of the electrophotographic image forming apparatus.

3. A process cartridge according to claim 2, wherein a portion of the bottom face side of said frame body at which said pushed portion is provided corresponds to a position in the direction of the axial line in which said main board is provided.

4. A process cartridge according to any one of claims 2 and 3, wherein the amount of a moment of said electrophotographic photosensitive drum around an axial line in said pushed portion is larger than the amount of a moment around an axial line in said main board when said process cartridge is attached to the main body of the electrophotographic image forming apparatus.

5. A process cartridge according to claim 1, further comprising:

a positioning member configured and positioned to project from said frame body in one end side and another end side of said electrophotographic photosensitive drum in the direction of an axial line thereof and provided on a line coaxial with the axial line, said positioning member serving to guide said process cartridge when said process cartridge is attached to the main body of the electrophotographic image forming apparatus, and to position said process cartridge when said process cartridge is attached to the main body of the electrophotographic image forming apparatus; and a rotation regulating and abutting portion configured and positioned to abut a main body rotation regulating member provided in the main body of the electrophotographic image forming apparatus, said rotation regulating and abutting portion being provided on said frame body, and regulating said process cartridge so as to prevent rotation of said process cartridge around said positioning member when said process cartridge is attached to the main body of the electrophotographic image forming apparatus and said pushed portion is pushed by the main body pushing means.

6. A process cartridge that is detachable from a main body of an electrophotographic image forming apparatus including a main body electrical contact and a main body abutting member, comprising:

an electrophotographic photosensitive drum;

process means for acting on said electrophotographic photosensitive drum;

a frame body;

a memory element configured to store information;

a cartridge electrical contact portion that is electrically connected to said memory element, and is electrically connected to the main body electrical contact when said process cartridge is attached to the main body of the electrophotographic image forming apparatus;

a cartridge abutting portion projecting from said frame body, said cartridge abutting portion guiding the main body electrical contact to said cartridge electric contact portion when contacting the main body abutting member when said process cartridge is attached to the main body of the electrophotographic image forming apparatus; and an inclined plane provided in an upstream side of said cartridge abutting portion in an attachment direction in which said process cartridge is attached to the main body of the electrophotographic image forming apparatus, said inclined plane being configured and positioned to electrically connect the main body electrical contact, guided by the main body abutting member, to said cartridge electrical contact portion when said process cartridge is attached to the main body of the electrophotographic image forming apparatus.

7. A process cartridge according to claim 6, further comprising a main board provided at a portion of said frame body, having said memory element and said cartridge electrical contact, wherein said cartridge abutting portion is provided parallel to said main board in a direction orthogonal to the attachment direction, and an upstream edge of said inclined plane in the attachment direction is located at a position within the width of said cartridge electrical contact portion in the attachment direction.

8. A process cartridge according to claim 7, wherein said main board is provided in a mounting portion projecting from a top face side of said frame body when said process cartridge is attached to the main body of the electrophotographic image forming apparatus, wherein a clearance exists between the main body electrical contact and said frame body and between the main body electrical contact and said main board when said cartridge abutting portion abuts the main body abutting member.

9. A process cartridge according to any one of claims 7 and 8, wherein said main board is provided in a mounting portion projecting from a top face side of said frame body when said process cartridge is attached to the main body of the electrophotographic image forming apparatus, and the height of the mounting portion is such that a space is formed between the main body abutting member and a surface of said frame body when said process cartridge is attached to the main body of the electrophotographic image forming apparatus and the main body electrical contact electrically abuts said cartridge electrical contact.

10. A process cartridge according to claim 6, further comprising:

a cartridge supporting member positioning portion configured and positioned to position the main body electrical contact in an orthogonal direction orthogonal to the attachment direction by engaging with a main body supporting member positioning portion provided in a main body electrical contact supporting member having the main body electrical contact;

a cartridge attachment guide portion configured and positioned to guide said process cartridge in the orthogonal direction by engaging with a main body cartridge attachment guide portion provided in the main body of the electrophotographic image forming apparatus; and a groove portion provided in the attachment direction, and in which said cartridge supporting member positioning portion and said cartridge attachment guide portion are installed in parallel.

11. A process cartridge according to claim 10, further comprising:

a rotation regulating and abutting portion that is provided in a bottom of said groove portion, and abuts on a main body rotation regulating member provided in the main body of the electrophotographic image forming apparatus, and regulates said process cartridge to rotate in the same direction as a rotary direction of the electrophotographic photosensitive drum when said process cartridge is installed in an attachment position and said electrophotographic photosensitive drum receives a rotational driving force from the main body of the electrophotographic image forming apparatus.

12. An electrophotographic image forming apparatus that has a detachable process cartridge and forms an image on a recording medium, comprising:

(i) a main body electrical contact;

(ii) main body pushing means;

(iii) attachment means for detachably attaching the process cartridge comprising: an electrophotographic photosensitive drum; process means for acting on the electrophotographic photosensitive drum; a frame body; a memory element storing information; a cartridge electrical contact portion that is electrically connected to the memory element, and is electrically connected to said main body electrical contact when the process cartridge is attached to a main body of said electrophotographic image forming apparatus; and a pushed portion that is provided in the frame body, and wherein the pushed portion is pushed by said main body pushing means in the direction in which the cartridge electrical contact portion moves so as to be electrically connected to said main body electrical contact when the process cartridge is attached to the main body of said electrophotographic image forming apparatus; and (iv) conveying means for conveying the recording medium.

13. An electrophotographic image forming apparatus that has a detachable process cartridge and forms an image on a recording medium, comprising:

(i) a main body electrical contact;

(ii) a main body electrical contact supporting member configured and positioned to support said main body electrical contact;

(iii) a main body abutting portion provided in said main body electrical contact supporting member;

(iv) attachment means for detachably attaching the process cartridge comprising: an electrophotographic photosensitive drum; process means for acting on the electrophotographic photosensitive drum; a frame body; a memory element storing information; a cartridge electrical contact portion that is electrically connected to the memory element, and is electrically connected to said main body electrical contact when the process cartridge is attached to a main body of said electrophotographic image forming apparatus; a cartridge abutting portion that projects from the frame body, and guides said main body electrical contact to the cartridge electric contact portion by contacting said main body abutting portion when the process cartridge is attached to the main body of said electrophotographic image forming apparatus; and an inclined plane that is provided in an upstream side of the cartridge abutting portion in an attachment direction in which the process cartridge is attached to the main body of said electrophotographic image forming apparatus, and serves to electrically connect said main body electrical contact, guided by said main body abutting portion, to the cartridge electrical contact portion when the process cartridge is attached to the main body of said electrophotographic image forming apparatus; and (v) conveying means for conveying the recording medium.

14. An electrophotographic image forming apparatus according to claim 13, further comprising:

a main body supporting member positioning portion, provided on said main body electrical contact supporting member, configured and positioned to position said main body electrical contact in an orthogonal direction orthogonal to the attachment direction by engaging with a cartridge supporting member positioning portion of a groove provided in the process cartridge in the attachment direction; and a main body cartridge attachment guide portion, provided on the main body, configured and positioned to guide the process cartridge in the orthogonal direction by engaging with a cartridge attachment guide portion of the groove.

15. An electrophotographic image forming apparatus according to claim 13, further comprising: a rotation regulating member that is provided in a bottom of the main body and abuts on a bottom of a groove provided in the process cartridge, and regulates the process cartridge to rotate in the same direction as a rotary direction of the electrophotographic photosensitive drum when the process cartridge is installed in an attachment position and the electrophotographic photosensitive drum receives a rotation drive force from the main body of said electrophotographic image forming apparatus.

* * * * *